US008740339B2

(12) United States Patent
Yamazaki

(10) Patent No.: US 8,740,339 B2
(45) **Date of Patent: *Jun. 3, 2014**

(54) DEFECTIVE RECORDING ELEMENT DETECTING APPARATUS, DEFECTIVE RECORDING ELEMENT DETECTING METHOD, AND IMAGE FORMING APPARATUS

(75) Inventor: Yoshirou Yamazaki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 225 days.

This patent is subject to a terminal disclaimer.

(21) Appl. No.: 13/332,026

(22) Filed: Dec. 20, 2011

(65) Prior Publication Data

US 2012/0154477 A1 Jun. 21, 2012

(30) Foreign Application Priority Data

Dec. 21, 2010 (JP) ..... 2010-284953

(51) Int. Cl.
*B41J 29/393* (2006.01)
*B41J 29/38* (2006.01)
*B41J 2/12* (2006.01)

(52) U.S. Cl.
USPC ..... 347/19; 347/9; 347/13; 347/14; 347/78

(58) Field of Classification Search
USPC ..... 347/12–13, 19, 40–41, 47, 14, 9, 78
See application file for complete search history.

(56) References Cited

U.S. PATENT DOCUMENTS

| | | | | |
|---|---|---|---|---|
| 6,491,373 | B1 * | 12/2002 | Fujita et al. | 347/41 |
| 6,598,953 | B2 | 7/2003 | Bland | |
| 6,739,699 | B1 * | 5/2004 | Sender et al. | 347/43 |
| 7,726,760 | B2 * | 6/2010 | Ikefuji et al. | 347/13 |
| 2006/0274106 | A1 | 12/2006 | Park | |
| 2007/0040878 | A1 | 2/2007 | Ikefuji et al. | |
| 2009/0244167 | A1 | 10/2009 | Saita et al. | |
| 2012/0250040 | A1 * | 10/2012 | Yamazaki | 358/1.8 |

FOREIGN PATENT DOCUMENTS

| | | |
|---|---|---|
| JP | 2004-009474 A | 1/2004 |
| JP | 2006-069027 A | 3/2006 |
| JP | 2007-054970 A | 3/2007 |

* cited by examiner

*Primary Examiner* — Sarah Al Hashimi
(74) *Attorney, Agent, or Firm* — Birch, Stewart, Kolasch & Birch, LLP

(57) ABSTRACT

A defective recording element detecting apparatus includes: an image signal acquiring device which acquires read image signals obtained by reading, a linear test pattern recorded by an image recording apparatus having: a recording head and a medium conveying device which causes relative movement between a recording medium and the recording head in a signal decomposing device which sequentially assigns reading pixel numbers 0 to n to the acquired read image signals, divides the reading pixel numbers by an analysis pitch unit PS to obtain remainders, and decomposes the read image signals into an image signal of each of the obtained remainders; a fluctuation signal calculating device which calculates a fluctuation signal of each of the remainders; and an identifying device which identifies a defective recording element among the plurality of recording elements based on the fluctuation signal of each of the remainders.

11 Claims, 30 Drawing Sheets

FIG.16A

| | 2 | 3 | 4 | 5 | 6 | 7 | 8 | 9 | 10 |
|---|---|---|---|---|---|---|---|---|---|
| 2 | 59.27 | 110.1 | 160.9 | 211.7 | 262.5 | 313.3 | 364.1 | 414.9 | 465.7 |
| 3 | 38.1 | 88.9 | 139.7 | 190.5 | 241.3 | 292.1 | 342.9 | 393.7 | 444.5 |
| 4 | 16.93 | 67.73 | 118.5 | 169.3 | 220.1 | 270.9 | 321.7 | 372.5 | 423.3 |
| 5 | 4.233 | 46.57 | 97.37 | 148.2 | 199 | 249.8 | 300.6 | 351.4 | 402.2 |
| 6 | 25.4 | 25.4 | 76.2 | 127 | 177.8 | 228.6 | 279.4 | 330.2 | 381 |
| 7 | 46.57 | 4.233 | 55.03 | 105.8 | 156.6 | 207.4 | 258.2 | 309 | 359.8 |
| 8 | 67.73 | 16.93 | 33.87 | 84.67 | 135.5 | 186.3 | 237.1 | 287.9 | 338.7 |
| 9 | 88.9 | 38.1 | 12.7 | 63.5 | 114.3 | 165.1 | 215.9 | 266.7 | 317.5 |
| 10 | 110.1 | 59.27 | 8.467 | 42.33 | 93.13 | 143.9 | 194.7 | 245.5 | 296.3 |
| 11 | 131.2 | 80.43 | 29.63 | 21.17 | 71.97 | 122.8 | 173.6 | 224.4 | 275.2 |
| 12 | 152.4 | 101.6 | 50.8 | 0 | 50.8 | 101.6 | 152.4 | 203.2 | 254 |
| 13 | 173.6 | 122.8 | 71.97 | 21.17 | 29.63 | 80.43 | 131.2 | 182 | 232.8 |
| 14 | 194.7 | 143.9 | 93.13 | 42.33 | 8.467 | 59.27 | 110.1 | 160.9 | 211.7 |
| 15 | 215.9 | 165.1 | 114.3 | 63.5 | 12.7 | 38.1 | 88.9 | 139.7 | 190.5 |
| 16 | 237.1 | 186.3 | 135.5 | 84.67 | 33.87 | 16.93 | 67.73 | 118.5 | 169.3 |
| 17 | 258.2 | 207.4 | 156.6 | 105.8 | 55.03 | 4.233 | 46.57 | 97.37 | 148.2 |
| 18 | 279.4 | 228.6 | 177.8 | 127 | 76.2 | 25.4 | 25.4 | 76.2 | 127 |
| 19 | 300.6 | 249.8 | 199 | 148.2 | 97.37 | 46.57 | 4.233 | 55.03 | 105.8 |
| 20 | 321.7 | 270.9 | 220.1 | 169.3 | 118.5 | 67.73 | 16.93 | 33.87 | 84.67 |
| 21 | 342.9 | 292.1 | 241.3 | 190.5 | 139.7 | 88.9 | 38.1 | 12.7 | 63.5 |
| 22 | 364.1 | 313.3 | 262.5 | 211.7 | 160.9 | 110.1 | 59.27 | 8.467 | 42.33 |
| 23 | 385.2 | 334.4 | 283.6 | 232.8 | 182 | 131.2 | 80.43 | 29.63 | 21.17 |
| 24 | 406.4 | 355.6 | 304.8 | 254 | 203.2 | 152.4 | 101.6 | 50.8 | 0 |
| 25 | 427.6 | 376.8 | 326 | 275.2 | 224.4 | 173.6 | 122.8 | 71.97 | 21.17 |
| 26 | 448.7 | 397.9 | 347.1 | 296.3 | 245.5 | 194.7 | 143.9 | 93.13 | 42.33 |
| 27 | 469.9 | 419.1 | 368.3 | 317.5 | 266.7 | 215.9 | 165.1 | 114.3 | 63.5 |
| 28 | 491.1 | 440.3 | 389.5 | 338.7 | 287.9 | 237.1 | 186.3 | 135.5 | 84.67 |
| 29 | 512.2 | 461.4 | 410.6 | 359.8 | 309 | 258.2 | 207.4 | 156.6 | 105.8 |
| 30 | 533.4 | 482.6 | 431.8 | 381 | 330.2 | 279.4 | 228.6 | 177.8 | 127 |

FIG.16B

| | 2 | 3 | 4 | 5 | 6 | 7 | 8 | 9 | 10 |
|---|---|---|---|---|---|---|---|---|---|
| 2 | 0.714 | 0.385 | 0.263 | 0.2 | 0.161 | 0.135 | 0.116 | 0.102 | 0.091 |
| 3 | 1.667 | 0.714 | 0.455 | 0.333 | 0.263 | 0.217 | 0.185 | 0.161 | 0.143 |
| 4 | 5 | 1.25 | 0.714 | 0.5 | 0.385 | 0.313 | 0.263 | 0.227 | 0.2 |
| 5 | 25 | 2.273 | 1.087 | 0.714 | 0.532 | 0.424 | 0.352 | 0.301 | 0.263 |
| 6 | 5 | 5 | 1.667 | 1 | 0.714 | 0.556 | 0.455 | 0.385 | 0.333 |
| 7 | 3.182 | 35 | 2.692 | 1.4 | 0.946 | 0.714 | 0.574 | 0.479 | 0.412 |
| 8 | 2.5 | 10 | 5 | 2 | 1.25 | 0.909 | 0.714 | 0.588 | 0.5 |
| 9 | 2.143 | 5 | 15 | 3 | 1.667 | 1.154 | 0.882 | 0.714 | 0.6 |
| 10 | 1.923 | 3.571 | 25 | 5 | 2.273 | 1.471 | 1.087 | 0.862 | 0.714 |
| 11 | 1.774 | 2.895 | 7.857 | 11 | 3.235 | 1.897 | 1.341 | 1.038 | 0.846 |
| 12 | 1.667 | 2.5 | 5 | ∞ | 5 | 2.5 | 1.667 | 1.25 | 1 |
| 13 | 1.585 | 2.241 | 3.824 | 13 | 9.286 | 3.421 | 2.097 | 1.512 | 1.182 |
| 14 | 1.522 | 2.059 | 3.182 | 7 | 35 | 5 | 2.692 | 1.842 | 1.4 |
| 15 | 1.471 | 1.923 | 2.778 | 5 | 25 | 8.333 | 3.571 | 2.273 | 1.667 |
| 16 | 1.429 | 1.818 | 2.5 | 4 | 10 | 20 | 5 | 2.857 | 2 |
| 17 | 1.393 | 1.735 | 2.297 | 3.4 | 6.538 | 85 | 7.727 | 3.696 | 2.429 |
| 18 | 1.364 | 1.667 | 2.143 | 3 | 5 | 15 | 15 | 5 | 3 |
| 19 | 1.338 | 1.61 | 2.021 | 2.714 | 4.13 | 8.636 | 95 | 7.308 | 3.8 |
| 20 | 1.316 | 1.563 | 1.923 | 2.5 | 3.571 | 6.25 | 25 | 12.5 | 5 |
| 21 | 1.296 | 1.522 | 1.842 | 2.333 | 3.182 | 5 | 11.67 | 35 | 7 |
| 22 | 1.279 | 1.486 | 1.774 | 2.2 | 2.895 | 4.231 | 7.857 | 55 | 11 |
| 23 | 1.264 | 1.456 | 1.716 | 2.091 | 2.674 | 3.71 | 6.053 | 16.43 | 23 |
| 24 | 1.25 | 1.429 | 1.667 | 2 | 2.5 | 3.333 | 5 | 10 | ∞ |
| 25 | 1.238 | 1.404 | 1.623 | 1.923 | 2.358 | 3.049 | 4.31 | 7.353 | 25 |
| 26 | 1.226 | 1.383 | 1.585 | 1.857 | 2.241 | 2.826 | 3.824 | 5.909 | 13 |
| 27 | 1.216 | 1.364 | 1.552 | 1.8 | 2.143 | 2.647 | 3.462 | 5 | 9 |
| 28 | 1.207 | 1.346 | 1.522 | 1.75 | 2.059 | 2.5 | 3.182 | 4.375 | 7 |
| 29 | 1.198 | 1.33 | 1.495 | 1.706 | 1.986 | 2.377 | 2.959 | 3.919 | 5.8 |
| 30 | 1.19 | 1.316 | 1.471 | 1.667 | 1.923 | 2.273 | 2.778 | 3.571 | 5 |

FIG.17A

| | 2 | 3 | 4 | 5 | 6 | 7 | 8 | 9 | 10 |
|---|---|---|---|---|---|---|---|---|---|
| 2 | 64.17 | 117.4 | 170.7 | 223.9 | 277.2 | 330.4 | 383.7 | 436.9 | 490.2 |
| 3 | 43 | 96.25 | 149.5 | 202.7 | 256 | 309.2 | 362.5 | 415.7 | 469 |
| 4 | 21.83 | 75.08 | 128.3 | 181.6 | 234.8 | 288.1 | 341.3 | 394.6 | 447.8 |
| 5 | 0.666 | 53.92 | 107.2 | 160.4 | 213.7 | 266.9 | 320.2 | 373.4 | 426.7 |
| 6 | 20.5 | 32.75 | 86 | 139.2 | 192.5 | 245.7 | 299 | 352.2 | 405.5 |
| 7 | 41.67 | 11.58 | 64.83 | 118.1 | 171.3 | 224.6 | 277.8 | 331.1 | 384.3 |
| 8 | 62.83 | 9.585 | 43.66 | 96.91 | 150.2 | 203.4 | 256.7 | 309.9 | 363.2 |
| 9 | 84 | 30.75 | 22.5 | 75.75 | 129 | 182.2 | 235.5 | 288.7 | 342 |
| 10 | 105.2 | 51.92 | 1.331 | 54.58 | 107.8 | 161.1 | 214.3 | 267.6 | 320.8 |
| 11 | 126.3 | 73.08 | 19.84 | 33.41 | 86.66 | 139.9 | 193.2 | 246.4 | 299.7 |
| 12 | 147.5 | 94.25 | 41 | 12.25 | 65.5 | 118.7 | 172 | 225.2 | 278.5 |
| 13 | 168.7 | 115.4 | 62.17 | 8.919 | 44.33 | 97.58 | 150.8 | 204.1 | 257.3 |
| 14 | 189.8 | 136.6 | 83.34 | 30.09 | 23.16 | 76.41 | 129.7 | 182.9 | 236.2 |
| 15 | 211 | 157.8 | 104.5 | 51.25 | 1.997 | 55.25 | 108.5 | 161.7 | 215 |
| 16 | 232.2 | 178.9 | 125.7 | 72.42 | 19.17 | 34.08 | 87.33 | 140.6 | 193.8 |
| 17 | 253.3 | 200.1 | 146.8 | 93.59 | 40.34 | 12.91 | 66.16 | 119.4 | 172.7 |
| 18 | 274.5 | 221.3 | 168 | 114.8 | 61.5 | 8.254 | 45 | 98.25 | 151.5 |
| 19 | 295.7 | 242.4 | 189.2 | 135.9 | 82.67 | 29.42 | 23.83 | 77.08 | 130.3 |
| 20 | 316.8 | 263.6 | 210.3 | 157.1 | 103.8 | 50.59 | 2.662 | 55.91 | 109.2 |
| 21 | 338 | 284.8 | 231.5 | 178.3 | 125 | 71.75 | 18.5 | 34.75 | 87.99 |
| 22 | 359.2 | 305.9 | 252.7 | 199.4 | 146.2 | 92.92 | 39.67 | 13.58 | 66.83 |
| 23 | 380.3 | 327.1 | 273.8 | 220.6 | 167.3 | 114.1 | 60.84 | 7.588 | 45.66 |
| 24 | 401.5 | 348.3 | 295 | 241.8 | 188.5 | 135.3 | 82 | 28.75 | 24.49 |
| 25 | 422.7 | 369.4 | 316.2 | 262.9 | 209.7 | 156.4 | 103.2 | 49.92 | 3.328 |
| 26 | 443.8 | 390.6 | 337.3 | 284.1 | 230.8 | 177.6 | 124.3 | 71.09 | 17.84 |
| 27 | 465 | 411.8 | 358.5 | 305.3 | 252 | 198.8 | 145.5 | 92.25 | 39.01 |
| 28 | 486.2 | 432.9 | 379.7 | 326.4 | 273.2 | 219.9 | 166.7 | 113.4 | 60.17 |
| 29 | 507.3 | 454.1 | 400.8 | 347.6 | 294.3 | 241.1 | 187.8 | 134.6 | 81.34 |
| 30 | 528.5 | 475.3 | 422 | 368.8 | 315.5 | 262.3 | 209 | 155.8 | 102.5 |

FIG.17B

| | 2 | 3 | 4 | 5 | 6 | 7 | 8 | 9 | 10 |
|---|---|---|---|---|---|---|---|---|---|
| 2 | 0.66 | 0.361 | 0.248 | 0.189 | 0.153 | 0.128 | 0.11 | 0.097 | 0.086 |
| 3 | 1.477 | 0.66 | 0.425 | 0.313 | 0.248 | 0.205 | 0.175 | 0.153 | 0.135 |
| 4 | 3.878 | 1.128 | 0.66 | 0.466 | 0.361 | 0.294 | 0.248 | 0.215 | 0.189 |
| 5 | 159 | 1.963 | 0.988 | 0.66 | 0.495 | 0.397 | 0.331 | 0.283 | 0.248 |
| 6 | 6.195 | 3.878 | 1.477 | 0.912 | 0.66 | 0.517 | 0.425 | 0.361 | 0.313 |
| 7 | 3.556 | 12.79 | 2.285 | 1.255 | 0.865 | 0.66 | 0.533 | 0.448 | 0.386 |
| 8 | 2.695 | 17.67 | 3.878 | 1.747 | 1.128 | 0.832 | 0.66 | 0.546 | 0.466 |
| 9 | 2.268 | 6.195 | 8.467 | 2.515 | 1.477 | 1.045 | 0.809 | 0.66 | 0.557 |
| 10 | 2.013 | 4.077 | 159 | 3.878 | 1.963 | 1.314 | 0.988 | 0.791 | 0.66 |
| 11 | 1.843 | 3.186 | 11.74 | 6.968 | 2.687 | 1.664 | 1.205 | 0.945 | 0.777 |
| 12 | 1.722 | 2.695 | 6.195 | 20.74 | 3.878 | 2.139 | 1.477 | 1.128 | 0.912 |
| 13 | 1.631 | 2.384 | 4.426 | 30.85 | 6.207 | 2.82 | 1.824 | 1.348 | 1.069 |
| 14 | 1.561 | 2.17 | 3.556 | 9.85 | 12.79 | 3.878 | 2.285 | 1.62 | 1.255 |
| 15 | 1.505 | 2.013 | 3.038 | 6.195 | 159 | 5.747 | 2.926 | 1.963 | 1.477 |
| 16 | 1.459 | 1.893 | 2.695 | 4.676 | 17.67 | 9.938 | 3.878 | 2.409 | 1.747 |
| 17 | 1.42 | 1.798 | 2.451 | 3.845 | 8.921 | 27.87 | 5.439 | 3.013 | 2.084 |
| 18 | 1.388 | 1.722 | 2.268 | 3.32 | 6.195 | 46.16 | 8.467 | 3.878 | 2.515 |
| 19 | 1.36 | 1.659 | 2.126 | 2.959 | 4.865 | 13.67 | 16.88 | 5.218 | 3.086 |
| 20 | 1.336 | 1.606 | 2.013 | 2.695 | 4.077 | 8.368 | 159 | 7.571 | 3.878 |
| 21 | 1.315 | 1.561 | 1.92 | 2.494 | 3.556 | 6.195 | 24.02 | 12.79 | 5.051 |
| 22 | 1.297 | 1.522 | 1.843 | 2.335 | 3.186 | 5.011 | 11.74 | 34.29 | 6.968 |
| 23 | 1.28 | 1.488 | 1.778 | 2.207 | 2.909 | 4.267 | 8.002 | 64.16 | 10.66 |
| 24 | 1.265 | 1.459 | 1.722 | 2.101 | 2.695 | 3.756 | 6.195 | 17.67 | 20.74 |
| 25 | 1.252 | 1.432 | 1.674 | 2.013 | 2.524 | 3.383 | 5.129 | 10.6 | 159 |
| 26 | 1.24 | 1.409 | 1.631 | 1.937 | 2.384 | 3.099 | 4.426 | 7.742 | 30.85 |
| 27 | 1.229 | 1.388 | 1.594 | 1.872 | 2.268 | 2.875 | 3.928 | 6.195 | 14.65 |
| 28 | 1.219 | 1.369 | 1.561 | 1.816 | 2.17 | 2.695 | 3.556 | 5.225 | 9.85 |
| 29 | 1.21 | 1.352 | 1.531 | 1.766 | 2.085 | 2.546 | 3.268 | 4.561 | 7.547 |
| 30 | 1.202 | 1.336 | 1.505 | 1.722 | 2.013 | 2.421 | 3.038 | 4.077 | 6.195 |

DEFECTIVE RECORDING ELEMENT DETECTING APPARATUS, DEFECTIVE RECORDING ELEMENT DETECTING METHOD, AND IMAGE FORMING APPARATUS

BACKGROUND OF THE INVENTION

1. Field of the Invention

The present invention relates to a detecting technique for identifying a defective recording element from a test pattern recording result produced by a recording head having a plurality of recording elements (for example, an inkjet head), and an image forming technique to which the detecting technique is applied.

2. Description of the Related Art

Methods of recording an image on a recording medium such as a recording paper include an inkjet rendering method in which ink drops are ejected from a recording head in accordance with an image signal in such a manner that the ink drops are landed on the recording medium. An example of an image rendering apparatus using such an inkjet rendering system is a full-line head image rendering apparatus in which an ejecting unit (a plurality of nozzles) that ejects ink drops is linearly disposed to correspond to an entire area of one side of a recording medium, and the recording medium is conveyed in a direction perpendicular to the ejecting unit in order to enable an image to be recorded on an entire area of the recording medium. Since a full-line head image rendering apparatus is capable of rendering an image on an entire area of a recording medium by conveying the recording medium without moving an ejecting unit, the full-line head image rendering apparatus is suitable for increasing recording speed.

However, with a full-line head image rendering apparatus, a deviation of an actual dot position that is recorded on a recording medium from an ideal dot position due to various reasons such as production variation, deterioration with age, or the like of recording elements (nozzles) constituting an ejecting unit may cause a recording position error (landing position error). As a result, a problem arises in that streaky artifacts occur in an image recorded on the recording medium. In addition to artifacts due to such a recording position error, there are phenomena in which streaky artifacts occur in a recorded image on the recording medium due to failures in a recording element such as an abnormality in which droplets are not ejected (non-ejection), an abnormality in ejection volume, and an abnormality in ejection shape (splash). Such recording elements which cause a decline in recording quality are collectively referred to as "defective ejection nozzles" or "defective recording elements". Since a length of a full-line recording head is equivalent to a width of a recording paper, for example, when recording resolution is 1200 DPI, recording elements of an apparatus capable of accommodating a recording paper having a paper width similar to that of half Kiku size (636 mm by 469 mm) number approximately 30,000 nozzles per ink. With such a large number of recording elements, defective ejection nozzles may occur at various timings. More specifically, a nozzle may become defective at the time of manufacture of a recording head, a nozzle may become defective due to deterioration with age, a nozzle may become defective during maintenance (when maintenance-induced, the nozzle is often restored to a normal nozzle by a next maintenance), and a recording element may become a defective ejection nozzle midway through continuous printing.

A technique is known in which, when a defective ejection nozzle occurs, usage of the defective ejection nozzle is suspended (ejection suspension) and other surrounding nozzles (nozzles capable of normal ejection) are used in order to correct an image. When applying such a correction technique, it is required that a defective ejection nozzle is accurately identified.

As techniques for identifying a defective ejection nozzle, Japanese Patent Application Publication No. 2004-009474, Japanese Patent Application Publication No. 2006-069027, and Japanese Patent Application Publication No. 2007-054970 describe methods of identifying a defective ejection nozzle by printing a predetermined test pattern aimed at detection of a defective ejection nozzle, reading a printing result with an image reading apparatus, and analyzing obtained read image data.

Japanese Patent Application Publication No. 2004-009474 discloses a configuration that uses a 1-on N-off detection test pattern. A reading apparatus (scanner) has a resolution that is equal to or higher than a print resolution, and binarizes a read result and detects a non-ejection nozzle.

In addition, Japanese Patent Application Publication No. 2006-069027 discloses a technique for detecting a defective nozzle position based on an average value of read results of a single row of interest among a test pattern and an average value of read results of m-number of rows that are to the left and right of the row of interest. In this case, it is assumed that a reading resolution of an image reading unit is favorably n-times a resolution of a line head (where n is a natural number equal to or greater than 2).

As described above, both Japanese Patent Application Publication No. 2004-009474 and Japanese Patent Application Publication No. 2006-069027 do not disclose a detection technique that addresses a problem of using a reading apparatus having a lower resolution than a line head.

In light of this problem, Japanese Patent Application Publication No. 2007-054970 discloses a technique involving using a scanner that reads at a lower resolution than a resolution of a recording head and interpolating read data to detect a defective nozzle.

However, the technique described in Japanese Patent Application Publication No. 2007-054970 has a problem in that since a certain amount of error (an estimation error of a line profile formed by dots) remains on a line position under a condition in which a width of a line formed by dots on a test pattern does not satisfy a sampling theorem, accuracy is not sufficiently high.

SUMMARY OF THE INVENTION

The present invention has been made in consideration of such circumstances, and an object of the present invention is to provide a defective recording element detecting apparatus, a defective recording element detecting method, and an image forming apparatus which use a reading apparatus (scanner) having a lower resolution than a recording head in order to accurately identify a defective recording element based on a simple operation.

In order to attain an object described above, one aspect of the present invention is directed to a defective recording element detecting apparatus comprising: an image signal acquiring device which acquires read image signals obtained by reading, at a read pitch WS in a first direction, a linear test pattern recorded by an image recording apparatus having: a recording head in which a plurality of recording elements are aligned so that, when the plurality of recording elements are projected on a straight line that is parallel to the first direction, an interval of projected recording elements is equal to a recording pitch WP; and a medium conveying device which causes relative movement between a recording medium and the recording head in a direction perpendicular to the first direction, the test pattern being recorded by operating recording elements corresponding to projected recording elements per every detection pitch unit PP among the projected recording elements; a signal decomposing device which sequentially assigns reading pixel numbers 0 to n (where n is a natural number) to the acquired read image signals starting from an end in the first direction, divides the reading pixel numbers by an analysis pitch unit PS to obtain remainders, and decomposes the read image signals into an image signal of each of the obtained remainders; a fluctuation signal calculating device which calculates a fluctuation signal of each of the remainders based on a predicted signal that is predicted for each of the remainders and on the image signal of each of the remainders; and an identifying device which identifies a defective recording element among the plurality of recording elements based on the fluctuation signal of each of the remainders, wherein a value of the analysis pitch unit PS is set in such a manner that a period T obtained by $T=WP\times PP/|WS\times PS-WP\times PP|$ is equal to or exceeds an analysis minimum period set in advance.

According to this aspect of the invention, with respect to read image signals obtained by reading, at a pitch WS, a linear test pattern recorded by operating recording elements having an interval of a detection unit PP among recording elements at a recording pitch WP, reading pixel numbers 0 to n (where n is a natural number) are sequentially assigned to the read image signals starting from an end, the reading pixel numbers are divided by an analysis pitch unit PS to obtain remainders, the read image signals are decomposed into an image signal of each of the obtained remainders, a fluctuation signal of each of the remainders is calculated based on a predicted signal that is predicted for each of the remainders and on the image signal of each of the remainders, and a defective recording element among the plurality of recording elements is identified based on the fluctuation signal of each of the remainders in such a manner that a value of the analysis pitch unit PS is set so that a period T obtained by $T=WP\times PP/|WS\times PS-WP\times PP|$ equals or exceeds an analysis minimum period set in advance. Therefore, the defective recording element can be accurately identified based on a simple calculation.

Desirably, the analysis minimum period is three.

According to this aspect of the invention, a defective recording element can be appropriately identified.

Desirably, the fluctuation signal calculating device generates the predicted signal that is predicted for each of the remainders based on the image signal of each of the remainders, and calculates the fluctuation signal of each of the remainders based on a difference between the generated predicted signal that is predicted for each of the remainders and the image signal of each of the remainders.

According to this aspect of the invention, a defective recording element can be identified by a simple operation.

Desirably, the fluctuation signal calculating device generates the predicted signal that is predicted for each of the remainders based on the image signal of each of the remainders, and calculates the fluctuation signal of each of the remainders based on a difference between the generated predicted signal that is predicted for each of the remainders and the image signal of each of the remainders.

According to this aspect of the invention, a defective recording element can be appropriately identified.

Desirably, the identifying device identifies the defective recording element based on a fluctuation signal that is least affected by noise among the fluctuation signals of the respective remainders.

According to this aspect of the invention, a defective recording element can be appropriately identified.

In order to attain an object described above, another aspect of the present invention is directed to an image forming apparatus comprising: the defective recording element detecting apparatus as defined in any one of the above aspects of the invention; a recording head in which a plurality of recording elements are aligned so that, when the plurality of recording elements are projected on a straight line that is parallel to a first direction, an interval of projected recording elements is equal to a recording pitch WP; a medium conveying device which causes relative movement between a recording medium and the recording head in a direction perpendicular to the first direction; a first recording control device which operates recording elements corresponding to projected recording elements per every detection unit PP among the projected recording elements so as to record a linear test pattern; a test pattern reading device which reads and converts the linear test pattern into a read image signal, the read image signal being read at a read pitch WS in the first direction; a storing device which stores information on the identified defective recording element; an image correcting device which stops a recording operation of the identified defective recording element and which corrects image data by compensating a recording defect of the defective recording element using the recording elements other than the defective recording element so as to record a target image; and a second recording control device which controls recording operations of the recording elements other than the defective recording element according to image data that has been corrected by the image correcting device, so as to perform image recording.

According to this aspect of the invention, information on an identified defective recording element is stored in a storing device, a recording operation of the identified defective recording element is stopped, image data is corrected by compensating a recording defect of the defective recording element using recording elements other than the defective recording element to record a target image, and recording operations of the recording elements other than the defective recording element are controlled according to image data having been corrected by the image correcting device to perform image recording. Therefore, the defective recording element can be accurately identified based on a simple operation, and image recording can be performed by a recording element other than the defective recording element. The first and second recording control devices can be achieved by a single unit or separate units.

Desirably, the WS is greater than the WP.

According to this aspect of the invention, a defective recording element can be appropriately identified even if a reading resolution of a test pattern reading device is lower than a recording resolution of a plurality of recording heads.

Desirably, a line width of the test pattern is within a range from 0.5 to 2 times the WS.

According to this aspect of the invention, a defective recording element can be appropriately identified.

Desirably, the recording elements have ink ejection nozzles, and the defective recording element is based on at least one of a significant position error, a non-ejection, and a significant ejection volume error.

According to this aspect of the invention, a recording element of an ink ejection nozzle can be used and at least one defect of a significant position error, a non-ejection, and a significant ejection volume error can be identified.

Desirably, the test pattern reading device is a line sensor in which a plurality of reading pixels are aligned at the read pitch WS in the first direction.

According to this aspect of the invention, a test pattern can be read in a short period of time and converted into a read image signal.

In order to attain an object described above, another aspect of the present invention is directed to a defective recording element detecting method comprising the steps of: acquiring read image signals obtained by reading, at a read pitch WS in a first direction, a linear test pattern recorded by an image recording apparatus having: a recording head in which a plurality of recording elements are aligned so that, when the plurality of recording elements are projected on a straight line that is parallel to the first direction, an interval of projected recording elements is equal to a recording pitch WP; and a medium conveying device which causes relative movement between a recording medium and the recording head in a direction perpendicular to the first direction, the test pattern being recorded by operating recording elements corresponding to projected recording elements per every detection unit PP among the projected recording elements; sequentially assigning reading pixel numbers 0 to n (where n is a natural number) to the acquired read image signals starting from an end in the first direction, dividing the reading pixel numbers by an analysis pitch unit PS to obtain remainders, and decomposing the read image signals into an image signal of each of the obtained remainders; calculating a fluctuation signal of each of the remainders based on a predicted signal that is predicted for each of the remainders and on the image signal of each of the remainders; and identifying a defective recording element among the plurality of recording elements based on the fluctuation signal of each of the remainders, wherein a value of the analysis pitch unit PS is set in such a manner that a period T obtained by $T=WP\times PP/|WS\times PS-WP\times PP|$ is equal to or exceeds an analysis minimum period set in advance.

According to the present invention, a defective recording element can be accurately identified by a simple operation even when using a reading device having a lower resolution than a recording head.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein:

FIGS. 16A and 16B are tables showing pitch differences and periods of respective combinations of detection units and analysis units;

FIGS. 17A and 17B are tables showing pitch differences and periods of respective combinations of detection units and analysis units;

DESCRIPTION OF THE PREFERRED EMBODIMENTS

Description of Landing Position Error

Figure 1A:
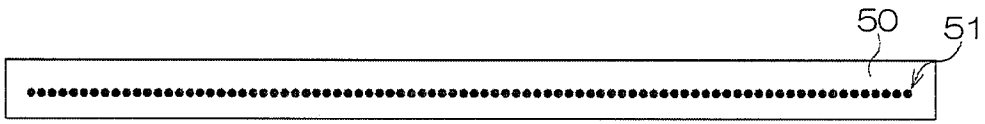
FIGS. 1A to 1C are diagrams that schematically describe a state where a landing position of an ink drop ejected from a nozzle on a recording medium deviates from an ideal landing position.
Figure 1B:
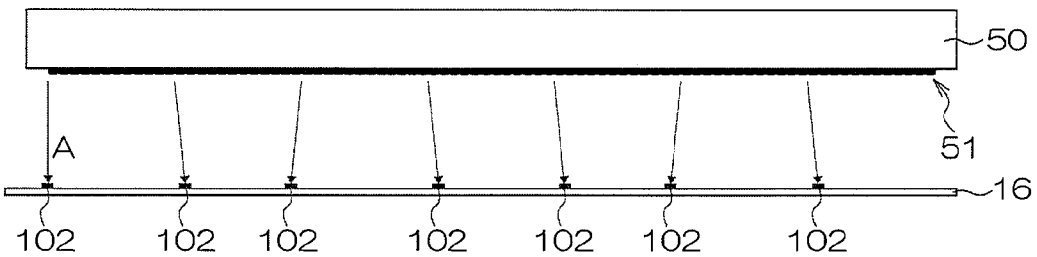
Figure 1C:
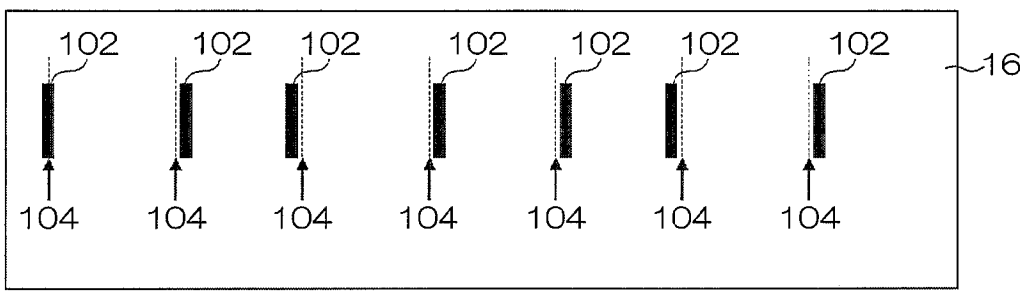

First, a landing position (recording position) error will be described as an example of a defective ejection nozzle. FIGS. 1A to 1C are diagrams that schematically describe a state where a landing position of an ink drop ejected from a nozzle on a recording medium deviates from an ideal landing position. FIG. 1A is a plan view showing a line alignment of a plurality of nozzles 51 of a head 50. FIG. 1B is a diagram in which a state where ink drops are ejected from nozzles 51 toward a recording paper (recording medium) 16 is viewed from a lateral direction. Arrows A in the diagram schematically show directions of ejection of ink drops from nozzles 51. FIG. 1C is a diagram showing examples of a test pattern 102 formed on a recording paper 16 by ink drops ejected from the nozzles 51, wherein ideal landing positions (reference numeral 104) are indicated by dotted lines and actual landing positions (reference numeral 102) are indicated by solid black lines.

Moreover, while FIGS. 1A and 1B show the head 50 in which a plurality of nozzles 51 are arranged in a single row to simplify illustration, it is obvious that the present invention can also be applied to a matrix head in which a plurality of nozzles are arranged two-dimensionally. In other words, a two-dimensionally arranged nozzle group can be treated as being substantially the same as a single row of nozzles by considering a substantial row of nozzles orthographically-projected on a straight line in the main scanning direction.

As shown in FIGS. 1A to 1C, the plurality of nozzles 51 of the head 50 include normal nozzles demonstrating normal ejection characteristics as well as defective ejection nozzles in which a flight trajectory of an ejected ink drop deviates excessively from an original trajectory. A linear dot pattern (test pattern) 102 formed by ink drops which are ejected from a defective ejection nozzle and which land on the recording paper 16 deviates from an ideal landing position 104 and contributes to a deterioration in image quality.

Figure 2:
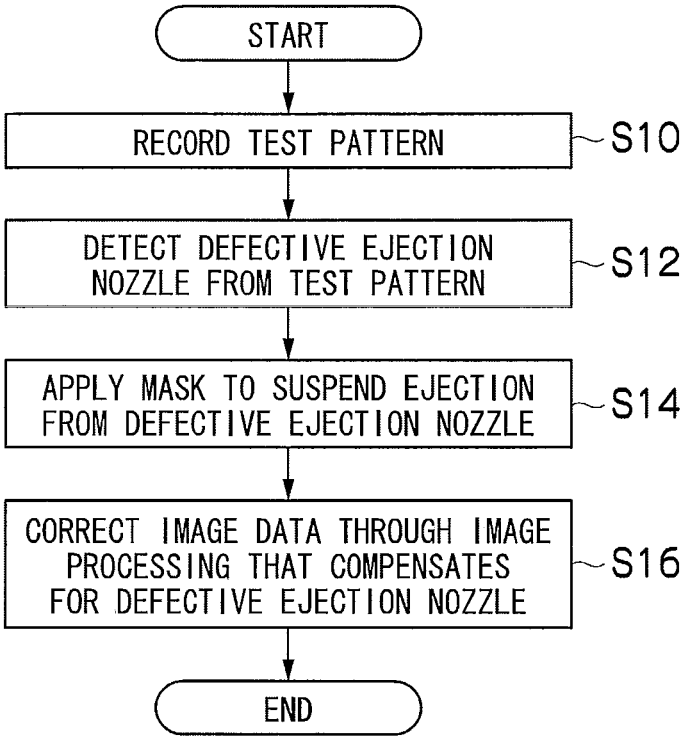
FIG. 2 is a flow chart showing an example of an image correcting process of an inkjet recording apparatus.

In a single-pass recording system that is a high-speed recording technique, nozzles corresponding to a paper width of a recording paper 16 may number in tens of thousands per ink, and in full-color recording, the number of recording elements are further multiplied by the number of ink colors (for example, four colors including cyan, magenta, yellow, and black). A basic operating procedure in a single-pass recording system inkjet recording apparatus (image forming apparatus) having a large number of recording elements is shown in FIG. 2. FIG. 2 shows an example of an image correcting process in which a defective recording element (defective ejection nozzle) is detected from a large number of recording elements and a rendering defection due to the defective recording element is corrected by other normal recording elements.

First, in order to grasp ejection characteristics of each nozzle, as shown in FIGS. 1A to 1C, ink drops are discharged from the respective nozzles 51 toward a recording paper 16 and the test pattern 102 is printed on the recording paper 16 (S10 in FIG. 2).

Figure 22:
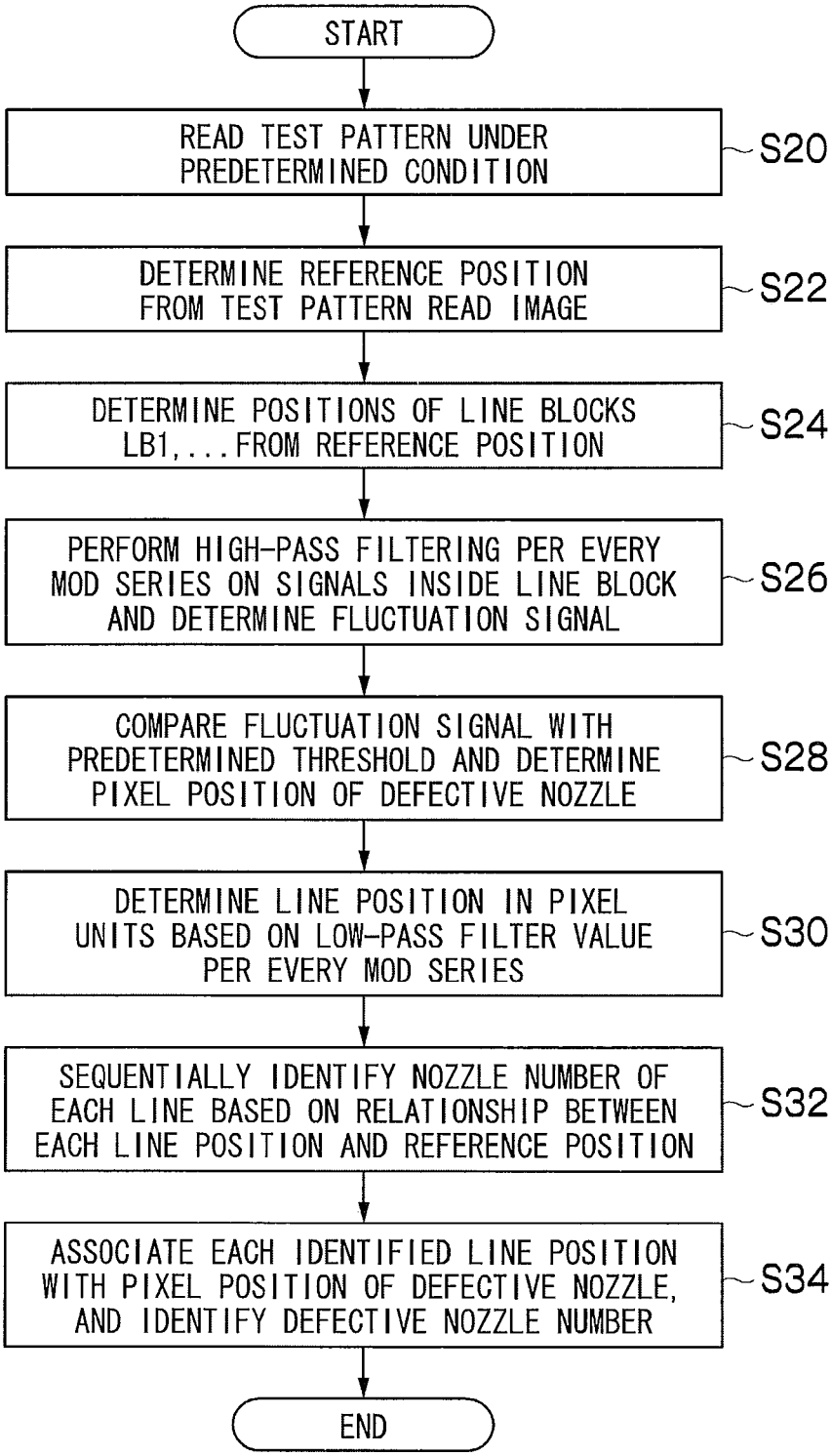
FIG. 22 is a flow chart showing a flow of processing for detecting a defective ejection nozzle.

This test pattern 102 is read by an image reading apparatus such as an imaging unit (in-line sensor) provided in the inkjet recording apparatus or an external scanner (off-line scanner), and electronic image data (read image data) indicating a recording result of the test pattern 102 is produced. As a result of an analysis of the read image data according to a predetermined detection algorithm, a position of a non-ejection nozzle and a landing position error from an ideal landing position 104 of the test pattern 102 are determined. At this point, a nozzle or a non-ejection nozzle having an excessive positional error that equals or exceeds a predetermined value (a value defining a predetermined allowable range) is detected and identified as a defective ejection nozzle (S12). A specific flow of the detection of a defective ejection nozzle will be described later (FIG. 22).

A defective ejection nozzle identified in this manner is subjected to masking and is treated as a non-ejection nozzle that does not eject ink drops during image formation (a non-ejection nozzle that is not used in recording) (S14). In addition, the input image data is corrected by image processing which can compensate for rendering defection caused by the non-ejection nozzle (nozzle subjected to ejection suspension) by an ink drop ejected from another ejection nozzle (for example, an adjacent nozzle) (S16). Based on the corrected input image data, a desired image is recorded with favorable quality on the recording paper 16.

Figure 3:
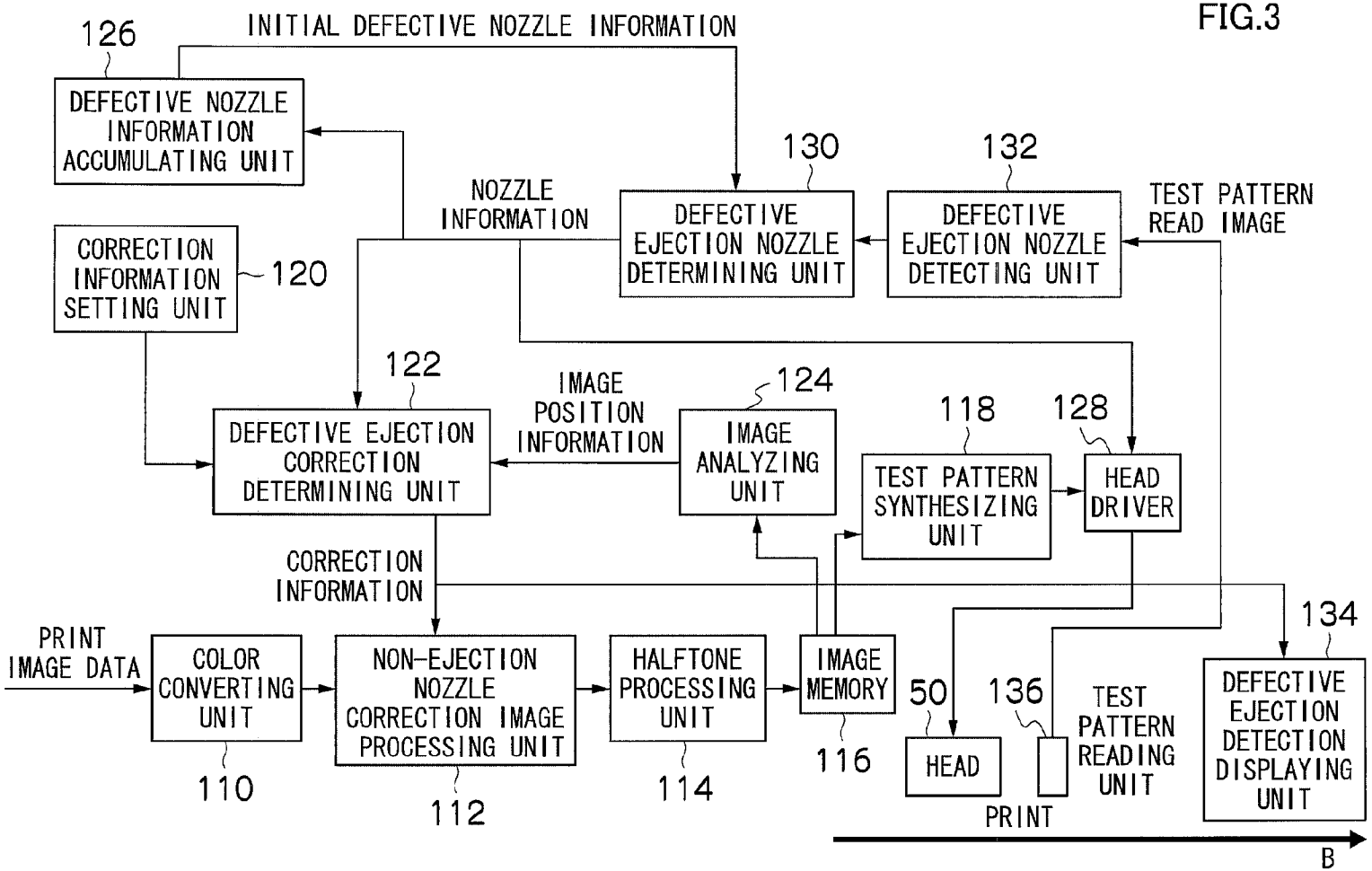
FIG. 3 is a functional block diagram of a system related to detection of a defective ejection nozzle and correction of input image data.

Next, a flow of a series of processing including detection of a defective ejection nozzle and correction of input image data will be described. FIG. 3 is a functional block diagram of a system related to detection processing of a defective ejection nozzle and correction processing of input image data.

Print image data of a print object is subjected to predetermined color conversion at a color converting unit 110 and image data of each color separation corresponding to recording ink (in the present example, CMYK inks) is obtained. The color image data per ink that is obtained in this manner is sent from the color converting unit 110 to a non-ejection nozzle correction image processing unit 112.

A defective ejection correction determining unit 122 comprehensively acquires defective nozzle correction information, and identifies a corrected image position that is a position on an image on which, under normal circumstances, dots are recorded by the defective ejection nozzle, from a correspondence relationship between an image position (image dot position) and a nozzle position. In this relationship, the "position" as used herein refers to a position in terms of a nozzle alignment direction (main scanning direction) of the recording head.

A defective ejection nozzle is incapable of appropriately recording an image portion at the corrected image position. The defective ejection correction determining unit 122 therefore assigns recording information of a portion at the corrected image position that corresponds to the defective ejection nozzle to a single neighboring normal nozzle or a plurality of neighboring normal nozzles of the defective ejection nozzle including nozzles on both sides of the defective ejection nozzle. "Assigning of recording information that corresponds to a defective ejection nozzle" as used herein refers to data processing (correction) for causing ink to be ejected from another nozzle(s) so that recording of a portion at the corrected image position that corresponds to the defective ejection nozzle is compensated by ink ejection from another nozzle(s). Furthermore, the defective ejection correction determining unit 122 corrects image information assigned in this manner according to recording characteristics.

Moreover, the defective ejection correction determining unit 122 compares information from an image analyzing unit 124 (image position information data) with defective ejection nozzle information from a defective ejection nozzle determining unit 130 and creates correction information only for an image portion that is recorded by the defective ejection nozzle. At this point, by referring to data indicating a necessity of correction provided by a correction information setting unit 120 (for example, data indicating a correction area set on a print image and data indicating a correction area (per nozzle) set by a printing unit of the head 50), the defective ejection correction determining unit 122 is also capable of creating correction information only for a high necessity area in a more sophisticated manner. Correction information that is created in this manner is sent from the defective ejection correction determining unit 122 to the non-ejection nozzle correction image processing unit 112.

The non-ejection nozzle correction image processing unit 112 performs correction based on correction information related to the defective ejection nozzle which is sent from the defective ejection correction determining unit 122, on image data sent from the color converting unit 110. Image data after correction which reflects non-ejection information of the defective ejection nozzle is sent from the non-ejection nozzle correction image processing unit 112 to a halftone processing unit 114.

The halftone processing unit 114 performs halftone processing on image data sent from the non-ejection nozzle correction image processing unit 112 and generates multivalued image data for driving the head 50. At this point, halftone processing is performed so that the generated multivalued image data (recording head driving multiple values) is smaller than an image gradation value (in other words, so that image gradation value>recording head driving multiple values is true).

Image data subjected to halftone processing is sent from the halftone processing unit 114 to an image memory 116. In addition, the image data subjected to halftone processing which is sent to the image memory 116 is also sent to the image analyzing unit 124. The image data subjected to halftone processing is stored in the image memory 116. At the same time, the image analyzing unit 124 analyzes the image data subjected to halftone processing and generates information (image position information data) related to a position for which image information exists (image position) and a position related to a position for which image information does not exist. Image position information data that is generated in this manner is sent from the image analyzing unit 124 to the defective ejection correction determining unit 122 and is used by the defective ejection correction determining unit 122 to generate correction information corresponding to the defective ejection nozzle.

Image data subjected to halftone processing (halftone image data) is also sent from the image memory 116 to a test pattern synthesizing unit 118.

The test pattern synthesizing unit 118 synthesizes halftone image data sent from the image memory 116 with image data regarding a test pattern (test pattern image data). The synthesized image data is sent to a head driver 128. While details will be described later, the test pattern refers to a dot pattern that is formed on a recording paper by each nozzle for the purpose of detecting a defective ejection nozzle. The test pattern image data and the halftone image data are synthesized by the test pattern synthesizing unit 118 so that the test pattern is printed on an edge of the recording paper.

Image data obtained by synthesizing the halftone image data and the test pattern image data is sent from the test pattern synthesizing unit 118 to the head driver 128. The head driver 128 drives the head 50 based on image data sent from the test pattern synthesizing unit 118 and records a desired image and the test pattern onto the recording paper. In this manner, a pattern forming device which uses ink drops ejected from nozzles to form a plurality of test patterns respectively corresponding to the nozzles is configured to include the test pattern synthesizing unit 118 and the head driver 128.

The recording paper on which the image and the test pattern have been recorded is sent toward a paper discharging unit along a paper conveyance path (please refer to arrow B in FIG. 3). At this point, a test pattern reading unit (image reading device) 136 installed in the middle of the paper path reads the test pattern recorded on the recording paper and generates data of a test pattern read image.

As the test pattern reading unit 136, for example, a color CCD line sensor is used which includes a color-specific photocell (pixel) array having three color filters of RGB and which is capable of reading a color image by RGB color separation. The test pattern reading unit 136 reads the recording paper 16 on which the test pattern 102 is formed at a predetermined reading pixel pitch in a longitudinal direction (nozzle row direction, main scanning direction, X-direction) of the head 50 and acquires test pattern read image data based on the reading pixel pitch. The test pattern read image data is sent from the test pattern reading unit 136 to a defective ejection nozzle detecting unit 132.

Here, the test pattern reading unit 136 may not be a line sensor. For example, the test pattern reading unit 136 may be configured to read the test pattern while scanning, in an XY direction, the recording paper on which the test pattern is recorded, even having a read width smaller than the width of the recording paper.

The defective ejection nozzle detecting unit 132 detects a defective ejection nozzle (including a defective nozzle whose landing position error of ejected ink drops on the recording paper is greater than a predetermined value, a defective nozzle having volume defect, and a non-ejection nozzle which does not eject ink drops) from data of a test pattern read image sent from the test pattern reading unit 136. Information data regarding a detected defective ejection nozzle (defective ejection nozzle information) is sent from the defective ejection nozzle detecting unit 132 to the defective ejection nozzle determining unit 130.

The defective ejection nozzle determining unit 130 includes a memory, not shown, which is capable of storing, a predetermined number of times, defective ejection nozzle information sent from the defective ejection nozzle detecting unit 132. The defective ejection nozzle determining unit 130 references previous defective ejection nozzle information stored in the memory and determines a defective ejection nozzle based on whether or not a nozzle has been previously detected as a defective ejection nozzle a predetermined number of times or more. In addition, when a nozzle has been previously determined as being a normal nozzle that is not a defective ejection nozzle a predetermined number of times or more, even if the nozzle has been treated until then as a defective ejection nozzle, the treatment of the nozzle is changed and defective ejection nozzle information is modified so that the nozzle is now treated as a normal nozzle.

Defective ejection nozzle information determined in this manner is sent from the defective ejection nozzle determining unit 130 to the head driver 128 and the defective ejection correction determining unit 122. In addition, when a predetermined condition is satisfied (for example, after printing of a predetermined number of pages, after a JOB, upon user instruction, or the like), the determined defective ejection nozzle information is also sent from the defective ejection nozzle determining unit 130 to a defective nozzle information accumulating unit 126.

Based on defective ejection nozzle information sent from the defective ejection nozzle determining unit 130, the head driver 128 stops driving of a nozzle corresponding to the defective ejection nozzle.

Furthermore, the defective ejection nozzle information sent to the defective nozzle information accumulating unit 126 is accumulated and stored in the defective nozzle to information accumulating unit 126 and is used as statistical information on the defective ejection nozzle. Moreover, the defective ejection nozzle information accumulated in the defective nozzle information accumulating unit 126 is sent as initial defective nozzle information at an appropriate timing to the defective ejection nozzle determining unit 130. Initial defective nozzle information as used herein refers to information indicating which nozzle (corresponding to CMYK ink) is a detective nozzle. Inspection information upon head shipment is set as an initial value of initial defective nozzle information. The initial defective nozzle information is updated on a timely basis based on defective ejection nozzle information that is accumulated in the defective nozzle information accumulating unit 126 at a specific frequency. The defective ejection nozzle determining unit 130 stores a necessary amount of defective ejection nozzle information among the initial defective nozzle information in a memory, not shown, at the start of printing or another timing, and uses the defective ejection nozzle information to determine a defective ejection nozzle.

The defective ejection correction determining unit 122 generates correction information on an image portion to be corrected (an image portion recorded by the defective ejection nozzle) from defective ejection nozzle information sent from the defective ejection nozzle determining unit 130, and sends the correction information to the non-ejection nozzle correction image processing unit 112.

In addition, the defective ejection correction determining unit 122 compares correction information generated in this manner with immediately-previous correction information to determine whether or not a defective ejection nozzle (favorably, a predetermined number of defective ejection nozzles or more) has newly occurred and correction information has increased. When it is found that correction information has increased, a predetermined instruction is sent from the defective ejection correction determining unit 122 to a defective ejection detection displaying unit 134.

The defective ejection detection displaying unit 134 having received the predetermined instruction performs processing which makes defective ejection printed matter on which recording by a new defective ejection nozzle is performed (in other words, printed matter which is printed without having correction performed on a new defective ejection nozzle) identifiable. Specifically, the defective ejection detection displaying unit 134 puts tags on printed paper (recording paper) ranging from printed paper from which a defection has been detected to printed paper on which correction has been performed and printing is to be started, and the like. In addition, upon printing after correction has been performed on a new defective ejection nozzle (upon printing based on image data (halftone image data) after correction has been performed), an instruction signal is sent from the defective ejection correction determining unit 122 to the defective ejection detection displaying unit 134 so that the predetermined instruction described above is disabled, and the defective ejection detection displaying unit 134 performs a normal operation (normal display).

Based on the flow of the series of processing described above, detection of a defective ejection nozzle and correction of input image data are appropriately performed. Moreover, depending on a stability of the head 50, configurations may be adopted in which the detection and correction described above are performed only on a first predetermined number of recording paper at start of printing (a configuration using an off-line scanner is also possible) or performed only when instructed by a user.

Description of Print Layout

Figure 4:
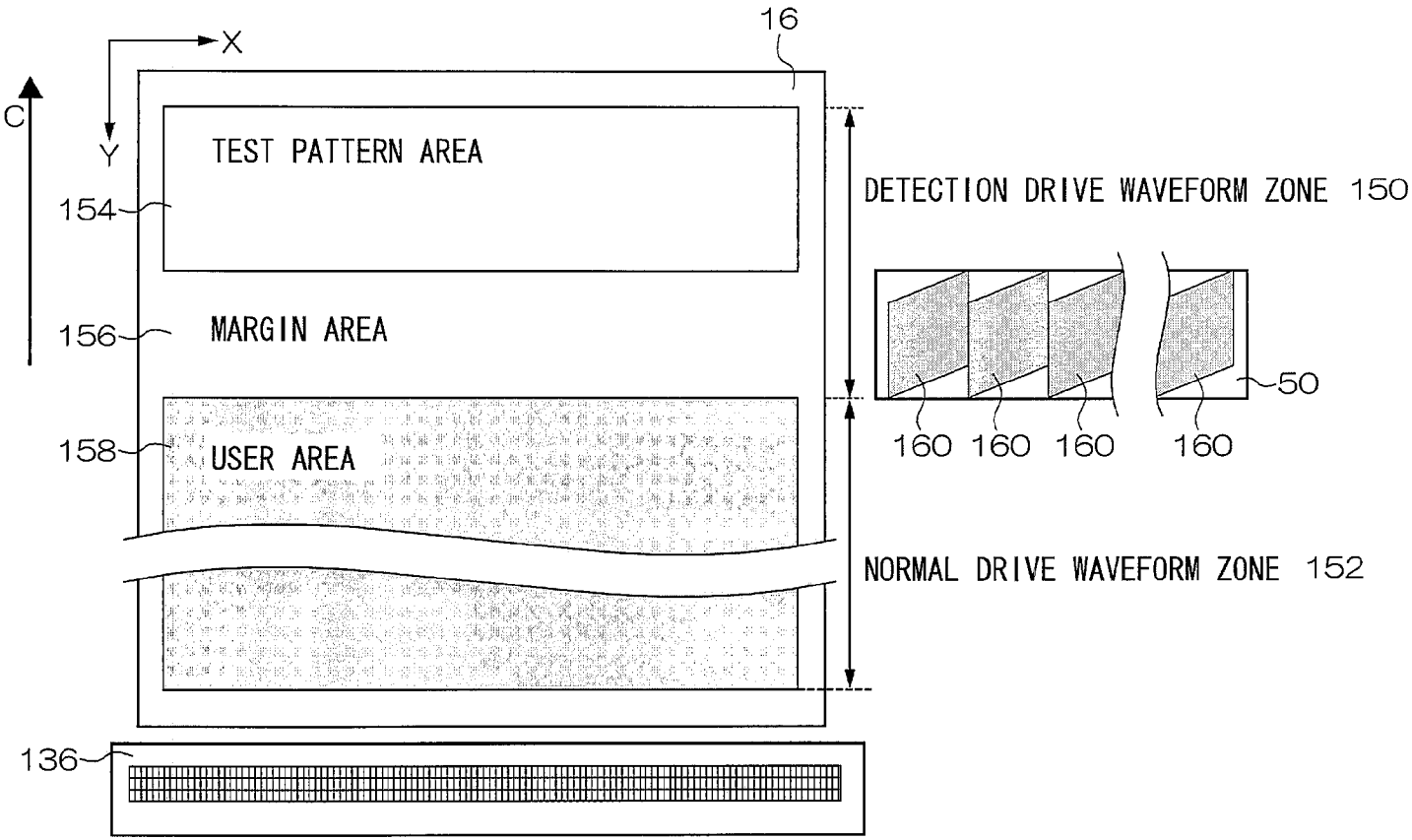
FIG. 4 is a diagram showing a layout on printing paper in a system that detects and corrects a defective ejection nozzle.

Next, an example of a print layout on the recording paper 16 will be described. FIG. 4 is a diagram showing a layout on printing paper in a system that detects and corrects a defective ejection nozzle. An upper side of FIG. 4 represents a tip side of the recording paper 16, and the recording paper 16 is conveyed from bottom to top (in a conveying direction indicated by an arrow C) in FIG. 4. For example, in a case of a drum conveying system in which a recording paper 16 is fixed on a peripheral surface of a drum, not shown, and the recording paper 16 is conveyed by a rotation of the drum, a configuration is adopted in which a tip portion of the recording paper 16 is held by a gripper provided on the drum.

The recording paper 16 is divided into a detection drive waveform zone 150 provided at a tip of the paper and a normal drive waveform zone 152. The detection drive waveform zone 150 includes a test pattern area 154 on which the test pattern 102 described above is printed and a margin area 156, and the normal drive waveform zone 152 is configured to include a user area 158 for printing a desired image.

The margin area 156 provided between the test pattern area 154 and the user area 158 is a transition interval for switching over from test pattern printing to normal printing. An area necessary for the switchover based on a conveying speed of the recording paper 16 is secured as the margin area 156. In particular, when forming a test pattern in the test pattern area 154 using a special drive waveform signal, a margin area is secured which corresponds to a period of time necessary for switching from the special drive waveform signal to the normal drive waveform signal. As the margin area 156, an area at least corresponding to the nozzle area 160 of the head 50 with respect to the conveying direction C of the recording paper 16 is favorably provided. Moreover, the special drive waveform signal for printing the test pattern 102 is used to make it easier to distinguish between a defective ejection nozzle and a normal ejection nozzle. A drive waveform signal that amplifies position error or a drive waveform signal that facilitates functioning of a defective ejection nozzle as a non-ejection nozzle can also be specially designed and used.

Description of Test Pattern

Figure 5:
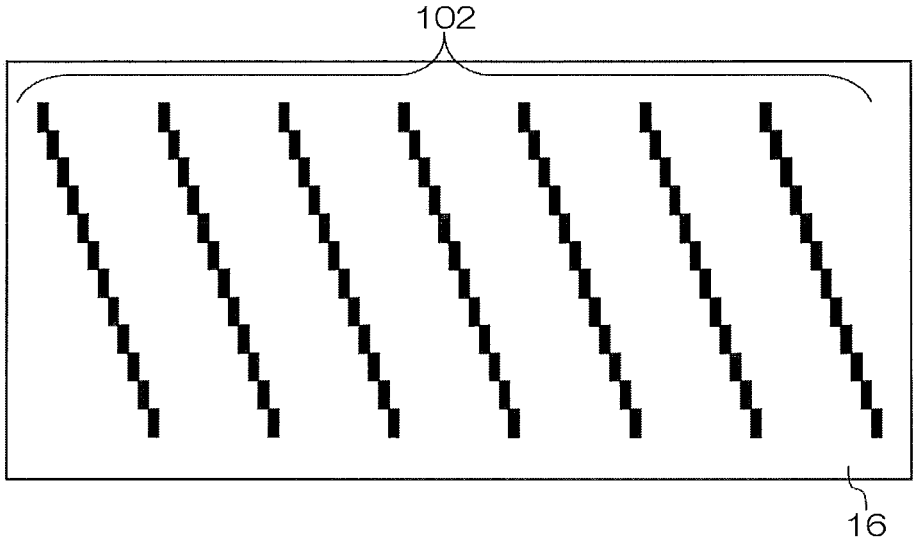
FIG. 5 is a diagram showing a basic form of a test pattern that is recorded on recording paper.
Figure 6:
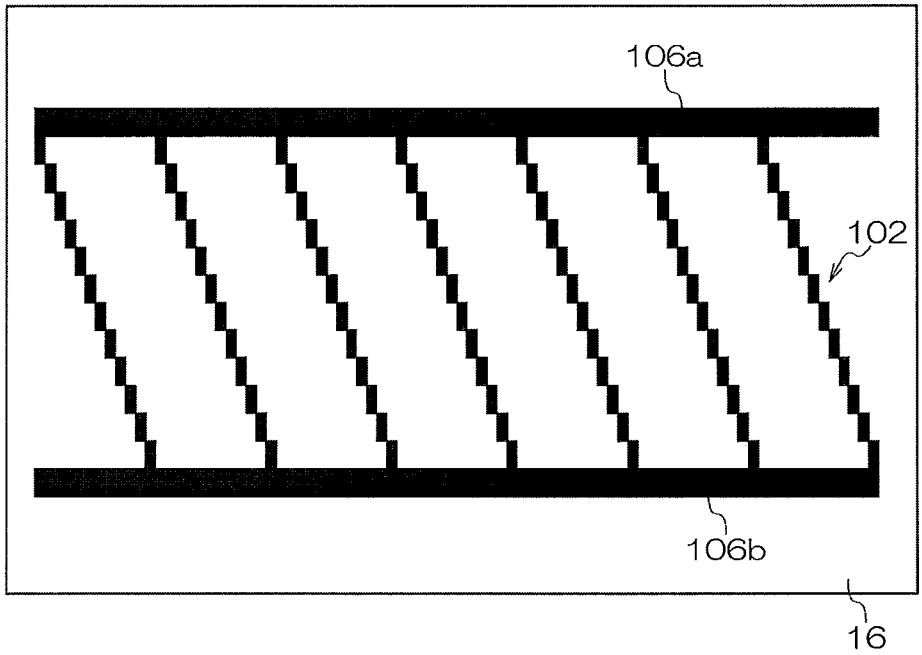
FIG. 6 is a diagram showing a specific example of a test pattern.

Next, a specific example of a test pattern will be described. FIG. 5 is a diagram showing a basic form of a test pattern that is recorded on recording paper (recording medium). FIG. 6 is a diagram showing a specific example of a test pattern and indicates a test pattern including a reference position detection bar. Moreover, FIGS. 5 and 6 provide an enlarged view of an end of the recording paper 16 on which the test pattern 102 is printed.

By conveying the recording paper 16 with respect to the recording head and driving the plurality of nozzles of the recording head at a certain interval, a basic portion of the linear test pattern 102 is created on the recording paper 16. In other words, ink drops are ejected per each nozzle block that is configured by a nozzle group having a predetermined interval among the plurality of nozzles of the recording head to form the linear test pattern 102, and by sequentially changing a nozzle block that ejects ink drops while the recording paper 16 is being conveyed, the test pattern 102 is formed in a staggered pattern as shown in FIG. 5. The test pattern 102 shown in FIG. 5 is a so-called "1-on n-off" line pattern. When an alignment of nozzles constituting a single row of nozzles substantially aligned along a paper-width direction (x-direction) (a substantial row of nozzles obtained by orthogonal projection) in a single line head is sequentially assigned nozzle numbers starting from an end in the x-direction of the nozzle alignment, an 1-on n-off line pattern such as that shown in FIG. 5 can be obtained by grouping simultaneously-ejecting nozzle groups according to a remainder "B" (B=0, 1, . . . , A−1) of a division of the nozzle numbers by an integer "A" that is equal to or greater than 2, varying an ejection timing for each group having nozzle numbers of AN+0, AN+1, . . . , AN+B (where N is an integer equal to or greater than 0), and forming a line group constituted by continuous ink drops from each nozzle.

FIG. 5 shows an example of "1-on 11-off" (A=12, B=0 to 11). While A=12 is exemplified in the present embodiment, generally, AN+B (B=0, 1, . . . , A−1), A is applicable to integers equal to or greater than 2.

By using such an 1-on n-off test pattern, adjacent lines do not overlap within each line block and independent (nozzle-specific) lines can be respectively formed for all nozzles which are distinguishable from other nozzles. Since each line constituting the test pattern 102 corresponds to ink ejection from each nozzle, by determining whether or not each line is appropriately formed, it is possible to determine whether or not ink drops are appropriately ejected from a corresponding nozzle.

Moreover, in addition to a so-called "1-on n-off" line pattern described above, a test pattern may include other patterns such as another line block (for example, a block for position error verification between line blocks), a horizontal line (partition line) that separates line blocks, reference position detection bars 106*a* and 106*b* shown in FIG. 6, and the like.

In the present embodiment, particularly, as shown in FIG. 6, reference position detection bars 106*a* and 106*b* are respectively recorded above and below the test pattern 102. As will be described later, the reference position detection bars 106*a* and 106*b* become a reference of position detection of the test pattern 102.

In a case of an inkjet printing apparatus having a plurality of heads for different ink colors, the same line pattern is formed for a head corresponding to each ink color (for example, heads corresponding to the respective colors of CMYK).

However, since an area of a non-image portion (a margin portion including the test pattern area 154 and the margin area 156 shown in FIG. 4) on the recording paper 16 is limited, line patterns (test chart) of all color heads and all nozzles cannot always be formed on a single recording paper 16. In such a case, the test pattern is formed across a plurality of sheets of recording paper.

Description of Test Pattern Read Image

Figure 7:
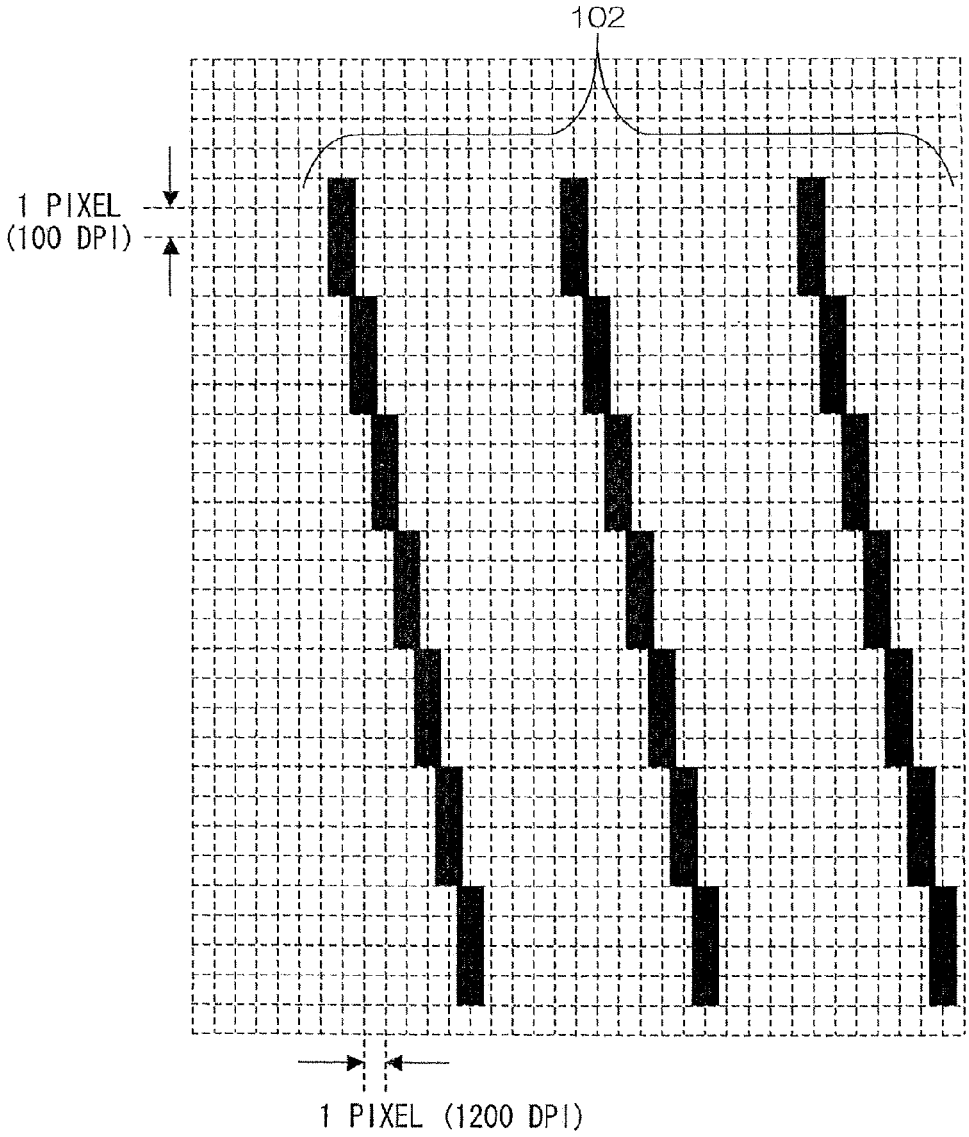
FIG. 7 is a conceptual diagram of a read image of a test pattern when reading resolution is set to 1200 DPI.

FIG. 7 is a conceptual diagram of a test pattern read image when a resolution of a printing apparatus is set to 1200 DPI (dots/inch). In the read image shown in FIG. 7, a length in a longitudinal direction (Y-direction, sub-scanning direction, paper-conveying direction) of each linear pattern corresponds to 4 pixels at 100 DPI and to 48 pixels at 1200 DPI.

Figure 8:
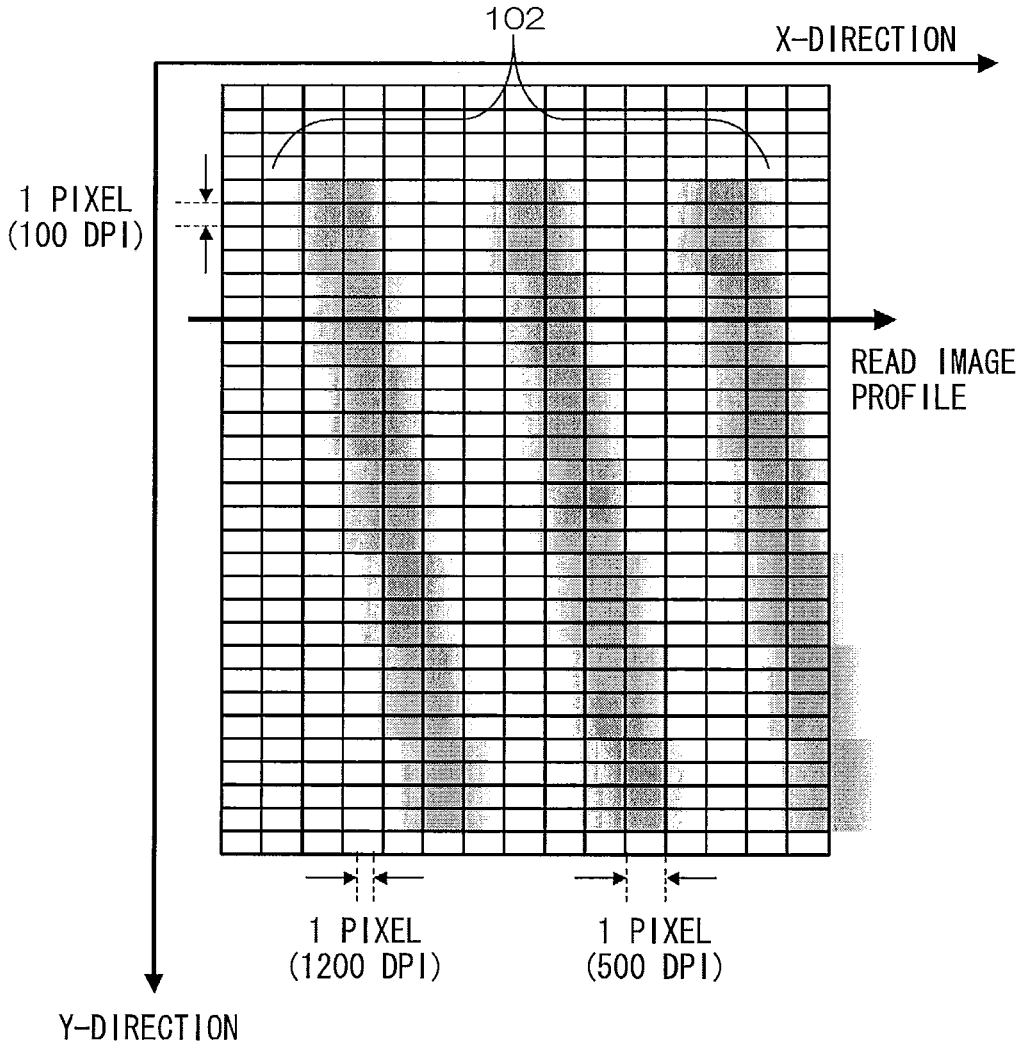
FIG. 8 is a conceptual diagram of a read image of a test pattern when reading resolution is set to 500 DPI.

FIG. 8 is a conceptual diagram of a test pattern read image when reading resolution (X-direction) is set to 500 DPI. As is apparent from FIG. 8, at a reading resolution of 500 DPI, each line of a read image of the test pattern 102 becomes blurry and makes it difficult to identify a distinctive contour.

While a high-resolution read image enables defective ejection nozzles to be identified by clearly detecting a position or width of each line, a low-resolution read image results in blurry contours and makes it difficult to simply identify a position or width of each line. However, with a high-resolution image reading apparatus (scanner), the apparatus itself is very expensive. Therefore, from a perspective of cost reduction, a method is desired which enables defective ejection nozzles to be identified using a low-resolution image reading apparatus.

In consideration thereof, an example of a method of accurately identifying a defective ejection nozzle from a low-resolution read image will be described below.

In the following description, an image density (grayscale, contrasting density) distribution when a read image is cut in one direction (X-direction) will be referred to as a profile. The profile need not necessarily indicate a density (grayscale) distribution for only a single pixel and, for example, an X-direction density (grayscale) distribution using a density (grayscale) averaged in a Y-direction may be adopted as a profile.

Principle of Detection of Defective Ejection Nozzle

Figure 9:
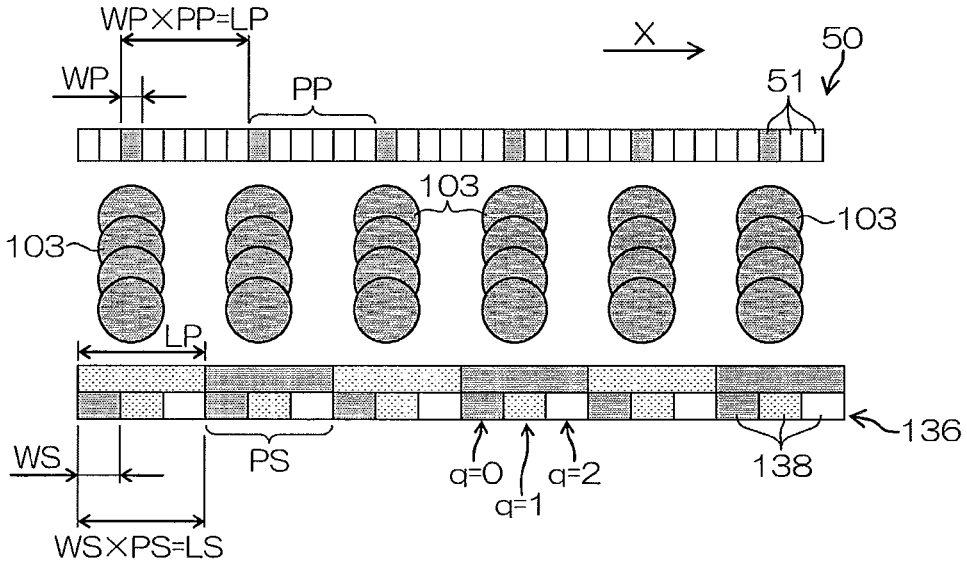
FIG. 9 is a diagram schematically representing a relationship among nozzles, lines, and reading pixels.

FIG. 9 is a diagram schematically representing a relationship among nozzles 51, lines 103, and respective reading pixels 138 of the test pattern reading unit 136 when each line 103 formed by a predetermined nozzle 51 among the nozzles 51 of the head 50 is read with the test pattern reading unit 136.

Here, if a recording pixel pitch in the X-direction (a pitch defining an X-direction printing resolution, printing pixel size) due to an alignment of the nozzles 51 is denoted by WP [μm], a detection unit (number of detection pitches, number of printing pixels) of the line 103 which is a row of pixels including a predetermined number of printing pixels successively aligned in the X-direction and bunched together to form a unit of detection is denoted by PP, a reading pixel pitch (reading pixel size) in the X-direction of the reading pixels 138 is denoted by WS [μm], and an analysis unit (number of analysis pitch, number of reading pixels) which is a row of pixels including a predetermined number of reading pixels 138 successively aligned in the X-direction and bunched together to form a unit of analysis is denoted by PS, then a detection pitch LP may be expressed as LP=PP×WP [μm] and an analysis pitch LS may be expressed as LS=PS×WS [μm]. In addition, a pitch difference ΔP between the detection pitch LP and the analysis pitch LS may be expressed as ΔP=LS−LP [μm].

Moreover, in this case, a scanner (test pattern reading unit 136) with a lower resolution than the recording resolution is used and the reading pixel pitch WS is greater than the recording pixel pitch WP (WS>WP).

FIG. 9 shows a case where ΔP=0 and, as an example, it is assumed that PP=6, WP=25400/1200 [μm], PS=3, and WS=25400/600 [μm].

Figure 10A:
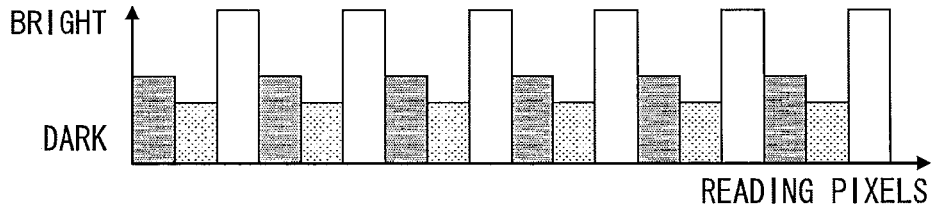
FIGS. 10A to 10E are graphs showing profiles of the respective reading pixels shown in FIG. 9.

FIG. 10A is a graph showing read results (read image signals) by the respective reading pixels 138 shown in FIG. 9.

With respect to these read image signals, reading pixel positions (reading pixel numbers) x=0, 1, 2, 3, . . . , in an analysis pitch direction (the X-direction in FIG. 9) are sequentially assigned from an end. In this case, the defective ejection nozzle detecting unit 132 divides the reading pixel position x by the analysis pitch unit PS to obtain a remainder q, decomposes (divides) a profile of a read image signal per the remainder q, calculates and obtains a fluctuation signal per the remainder q, and analyses it and identifies a defective ejection nozzle. Specifically, the defective ejection nozzle detecting unit 132 serves as a signal decomposing means, a fluctuation signal calculating means and an identifying means.

If a profile of the read image signal shown in FIG. 10A is denoted by Is(x), then a profile Isq (where q≡x mod PS) decomposed per remainder q may be expressed as follows.

$$Is0(k)=Is(PS\times k+0)(\text{where } q=0) \quad \text{Formula 1}$$

$$Is1(k)=Is(PS\times k+1)(\text{where } q=1) \quad \text{Formula 2}$$

$$Is2(k)=Is(PS\times k+2)(\text{where } q=2) \quad \text{Formula 3}$$

As shown in FIG. 9, the remainder q described above corresponds to a position (position within analysis pitch) of each reading pixel within the analysis pitch unit (number of analysis pitch) PS. Moreover, in the present specification, the remainder q may sometimes be referred to as a MOD series.

Figure 10B:
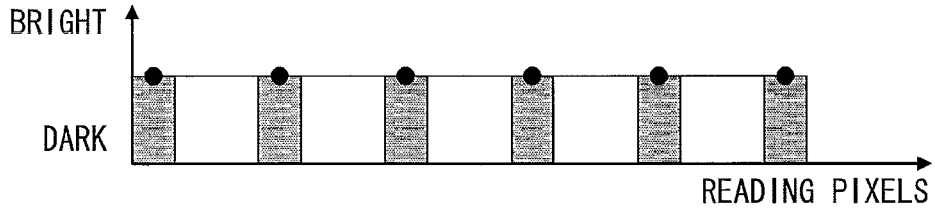
Figure 10C:
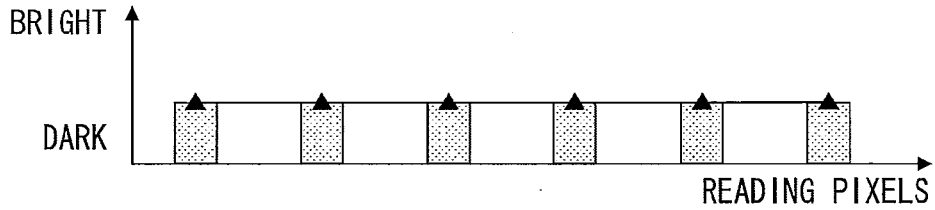
Figure 10D:
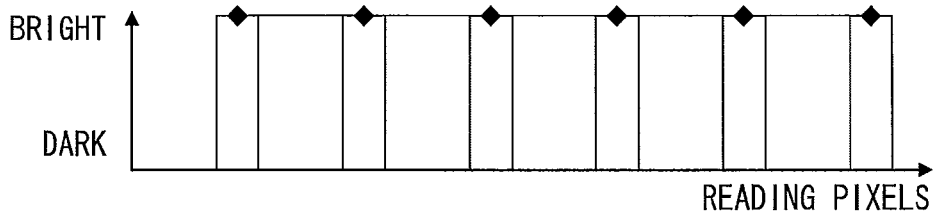

FIGS. 10B to 10D are graphs respectively plotting the profile Isq per every MOD series with respect to the read image signal shown in FIG. 10A. FIG. 10B shows a profile of Is0, FIG. 10C shows a profile of Is1, and FIG. 10D shows a profile of Is2.

Figure 10E:
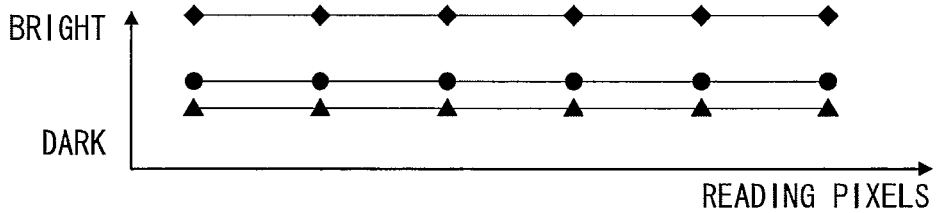

In addition, FIG. 10E is a graph showing the profiles Isq per every MOD series shown in FIGS. 10B to 10D overlapping each other. In FIG. 10E, positions of q on an abscissa (X axis) where k is consistent through (Formula 1) to (Formula 3) are shown conformed to each other.

In this case, since ΔP=0, in other words, phases of the detection pitch LP and the analysis pitch LS are consistent with each other, a relative positional relationship of the position within analysis pitch (q=x mod PS) and a line formed by a detection object nozzle is consistent as long as there is no landing position error. In other words, ideally, the profile Isq per every MOD series has a constant density (signal value) regardless of the reading pixel position x.

Figure 11:
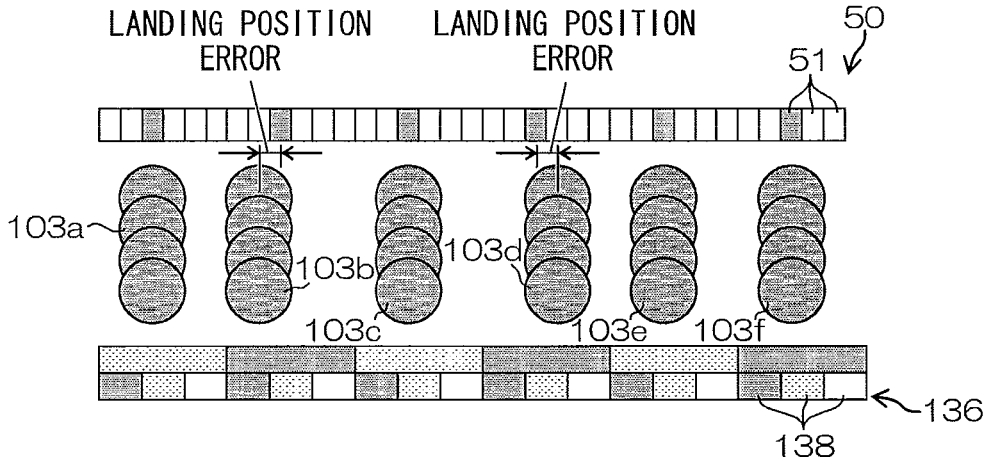
FIG. 11 is a diagram schematically representing a relationship among nozzles, lines, and reading pixels when a landing position error exists.

FIG. 11 is a diagram schematically representing a relationship among the nozzles 51, the lines 103, and the reading pixels 138 in the same manner as FIG. 9. FIG. 11 shows a case where landing position errors exist in a line 103*b* and a line 103*d* among lines 103*a* to 103*f*.

Figure 12A:
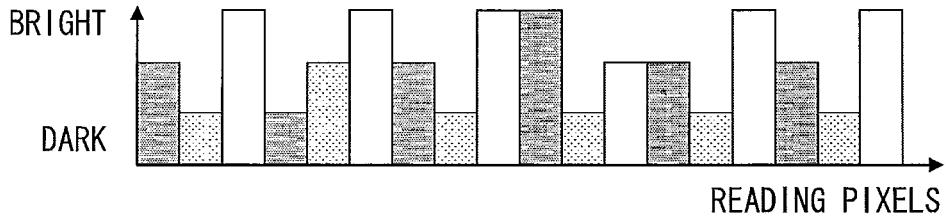
FIGS. 12A to 12E are graphs showing profiles of the respective reading pixels shown in FIG. 11.
Figure 12B:
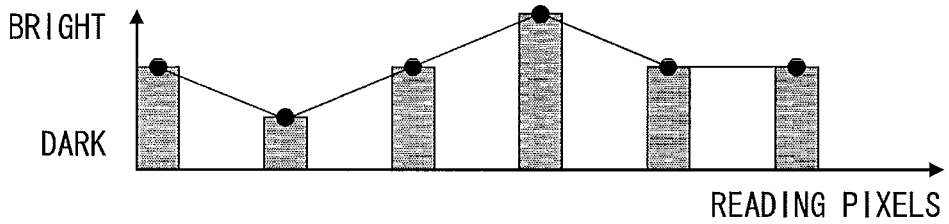
Figure 12C:
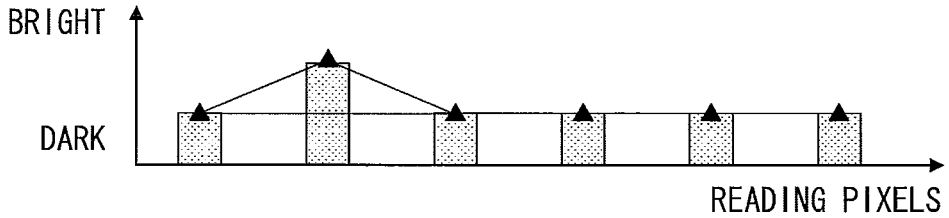
Figure 12D:
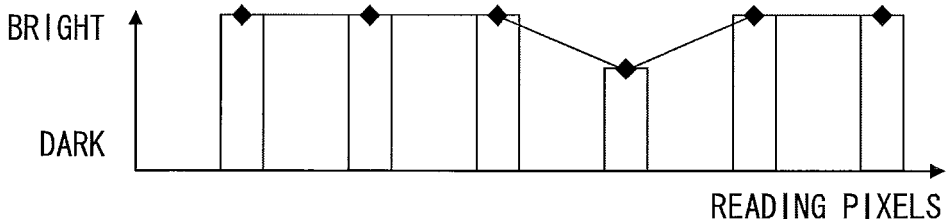

In addition, FIG. 12A is a graph showing read results of the respective reading pixels 138 shown in FIG. 11, and FIGS. 12B to 12D are graphs respectively plotting a profile decomposed per every MOD series with respect to the read image signal shown in FIG. 12A. FIG. 12B shows a profile of Is0, FIG. 12C shows a profile of Is1, and FIG. 12D shows a profile of Is2.

Figure 12E:
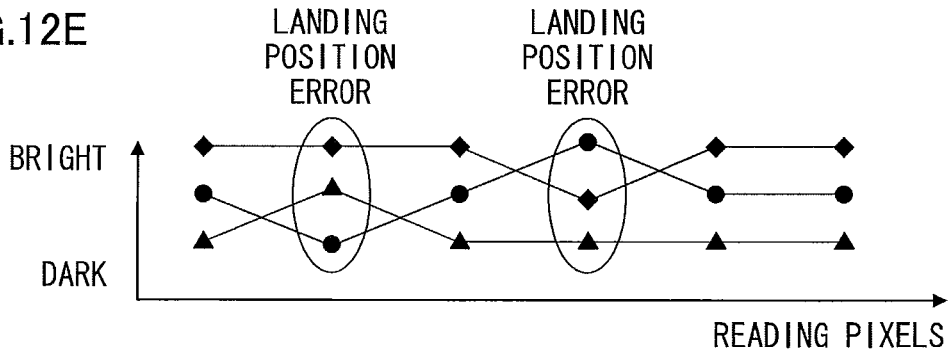

FIG. 12E is a graph showing the profiles Isq per every MOD series shown in FIGS. 12B to 12D overlapping each other.

As shown in FIGS. 12A to 12E, by focusing on the profile Isq that is retrieved per every MOD series, it is found that Isq fluctuates at a reading pixel position corresponding to a nozzle at which a landing position error has occurred. Specifically, profiles at a position of the line 103*b* and a position of the line 103*d* have fluctuated. As described above, by extracting a fluctuation signal from a profile per every MOD series, a defective ejection nozzle can be identified.

Principle of Detection when Phases are Different

While a case where phases of the detection pitch LP and the analysis pitch LS are consistent (ΔP=0) is described in the example above, a same process applies even if phases are inconsistent.

Figure 13A:
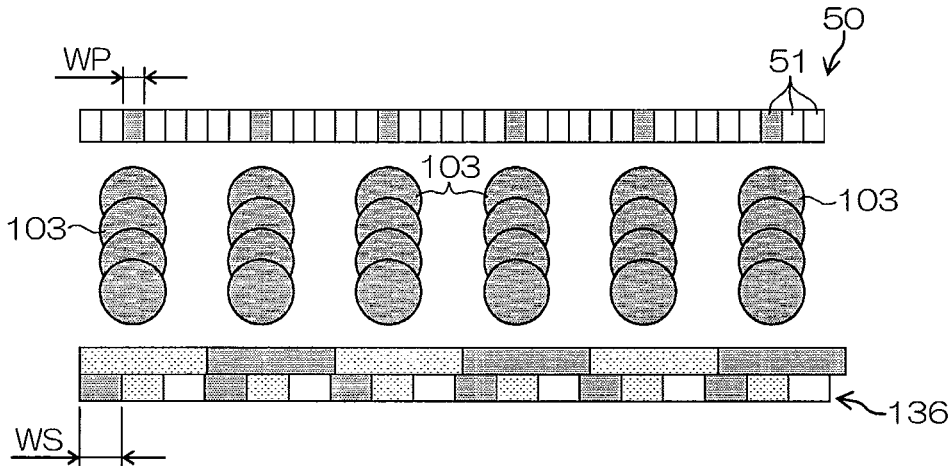
FIGS. 13A to 13C are diagrams schematically representing a relationship among nozzles, lines, and reading pixels when ΔP is negative.

FIG. 13A is a diagram schematically representing a relationship among nozzles 51, lines 103, and reading pixels 138 when the pitch difference ΔP has a negative value.

Figure 13B:
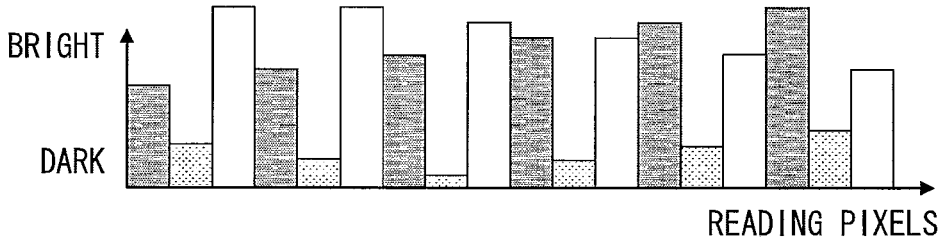
Figure 13C:
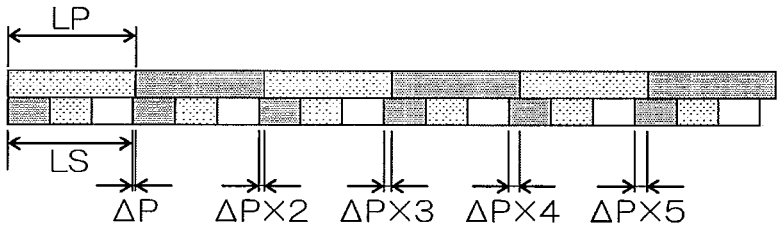

In addition, FIG. 13B is a graph showing read results of the respective reading pixels 138 shown in FIG. 13A, and FIG. 13C is a diagram for explaining how the pitch difference ΔP accumulates linearly each time sets of the detection unit PP and the analysis pitch unit PS increase.

Figure 14A:
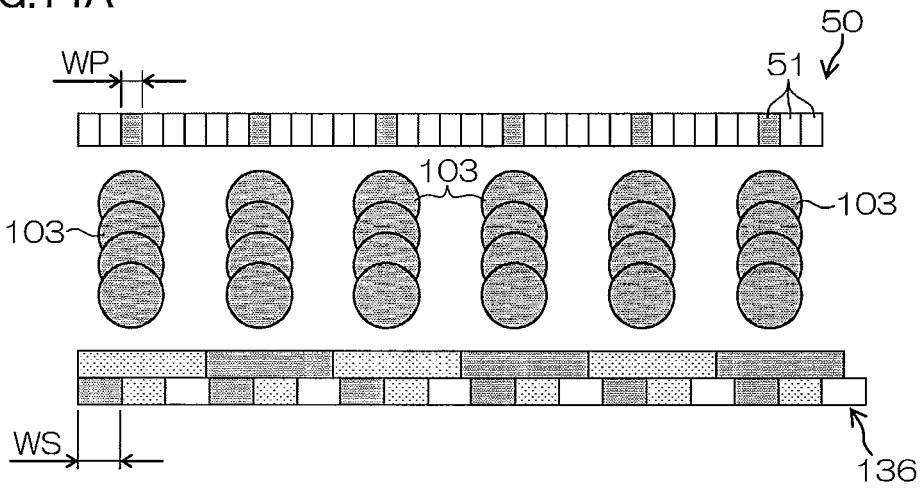
FIGS. 14A to 14C are diagrams schematically representing a relationship among nozzles, lines, and reading pixels when ΔP is positive.
Figure 14B:
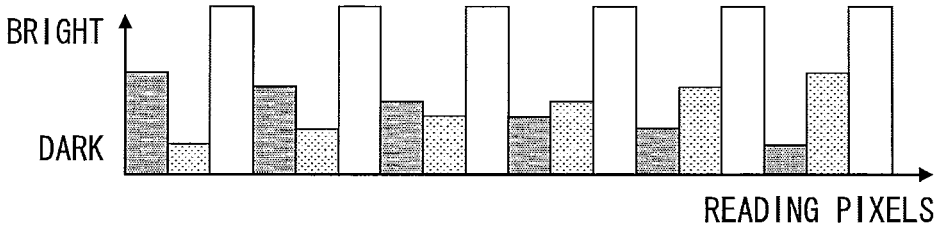
Figure 14C:
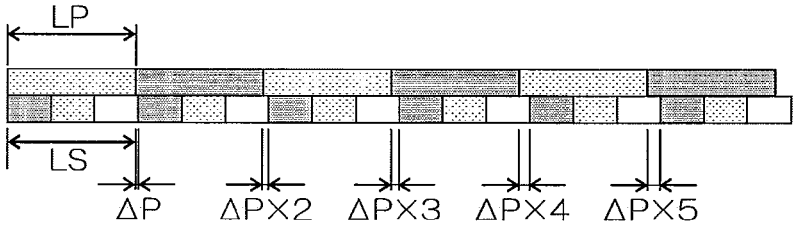

In a similar manner, FIG. 14A is a diagram schematically representing a relationship among nozzles 51, lines 103, and reading pixels 138 when the pitch difference ΔP has a positive value, FIG. 14B is a graph showing read results of the respective reading pixels 138 in the relationship shown in FIG. 14A, and FIG. 14C is a diagram for explaining how the pitch difference ΔP accumulates linearly each time sets of the detection unit PP and the analysis pitch unit PS increase.

Figure 15A:
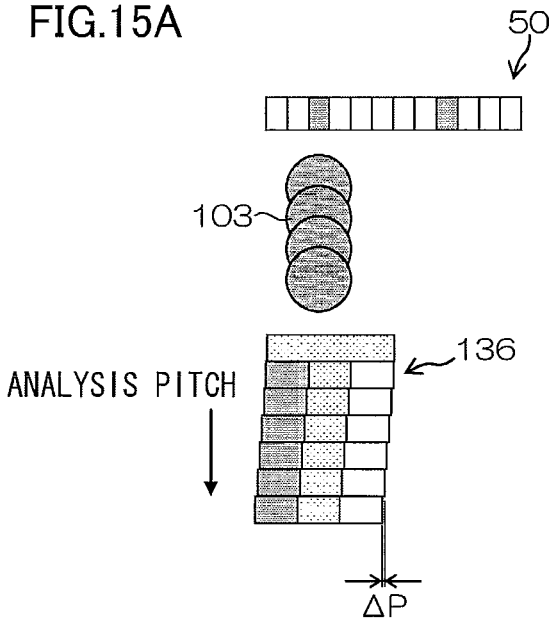
FIGS. 15A and 15B are diagrams showing relative positions of lines and reading pixels.
Figure 15B:
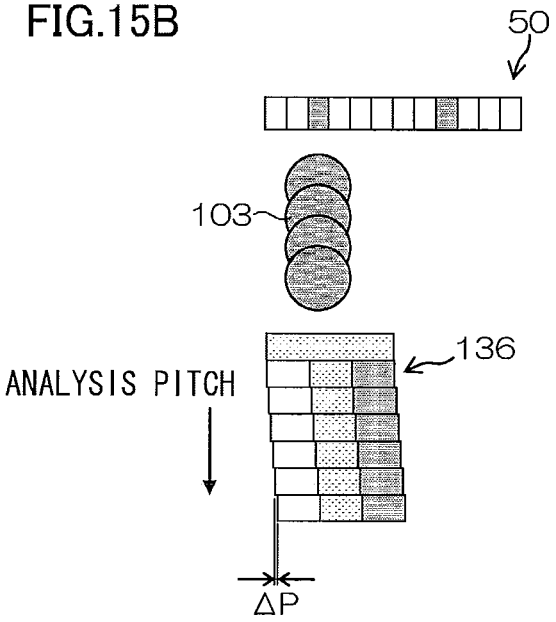

In addition, FIGS. 15A and 15B are diagrams showing how relative positions of lines and reading pixels regularly change as a result of a deviation (ΔP) between the analysis pitch LS and the detection pitch LP increasing every analysis pitch. FIG. 15A shows a case where the pitch difference ΔP is negative and FIG. 15B shows a case where the pitch difference ΔP is positive.

As shown in FIGS. 13A to 13C, FIGS. 14A to 14C and FIGS. 15A and 15B, since phases of the detection pitch LP and the analysis pitch LS are not consistent with each other, a relative positional relationship of the position within analysis pitch and a line formed by a detection object nozzle deviates by ΔP every time sets of the detection unit PP and the analysis pitch unit PS increase.

At this point, a profile per every MOD series varies over a period that ends when accumulated deviation ΔP becomes equal to the detection pitch LP. In other words, when the pitch difference ΔP is not zero but has a small absolute value, the profile Isq per every MOD series varies in extremely long periods. This period T can be obtained from Formula 4 below.

$$T = WP \times PP / |WS \times PS - WP \times PP| \quad \text{Formula 4}$$

The period T represents the number (k) of pixels of the profile Isq per every MOD series.

If the period T has a large value, a fluctuation signal can be extracted and a defective ejection nozzle can be identified according to the same principle as a case where the phases are consistent with each other (when ΔP=0). Therefore, the analysis pitch unit PS need only be determined so that the period T has a large value.

FIG. 16A is a table showing pitch differences ΔP [unit: μm] of respective combinations of the detection unit PP (ordinate) and the analysis pitch unit PS (abscissa) in a case where print resolution is 1200 [DPI] and read resolution is 500 [DPI], and FIG. 16B is a table showing periods T [unit: pixels] of profiles per every MOD series for the respective combinations shown in FIG. 1A. In addition, FIGS. 17A and 17B show tables which respectively show pitch differences ΔP [unit: μm] and periods T [unit: pixels] of profiles per every MOD series in a case where print resolution is 1200 [DPI] and read resolution is 477 [DPI].

When the period T is extremely large (ΔP=0 is infinite), detection accuracy is high. As the period T becomes shorter, it becomes more difficult to accurately compute signal variations that are generated due to a deviation in ΔP. In particular, conditions deteriorate significantly when T equals or falls below 3. Therefore, the period T is favorably greater than 3. Gray portions in FIGS. 16B and 17B represent combinations where T>3.

Example where PS=4

Figure 18:
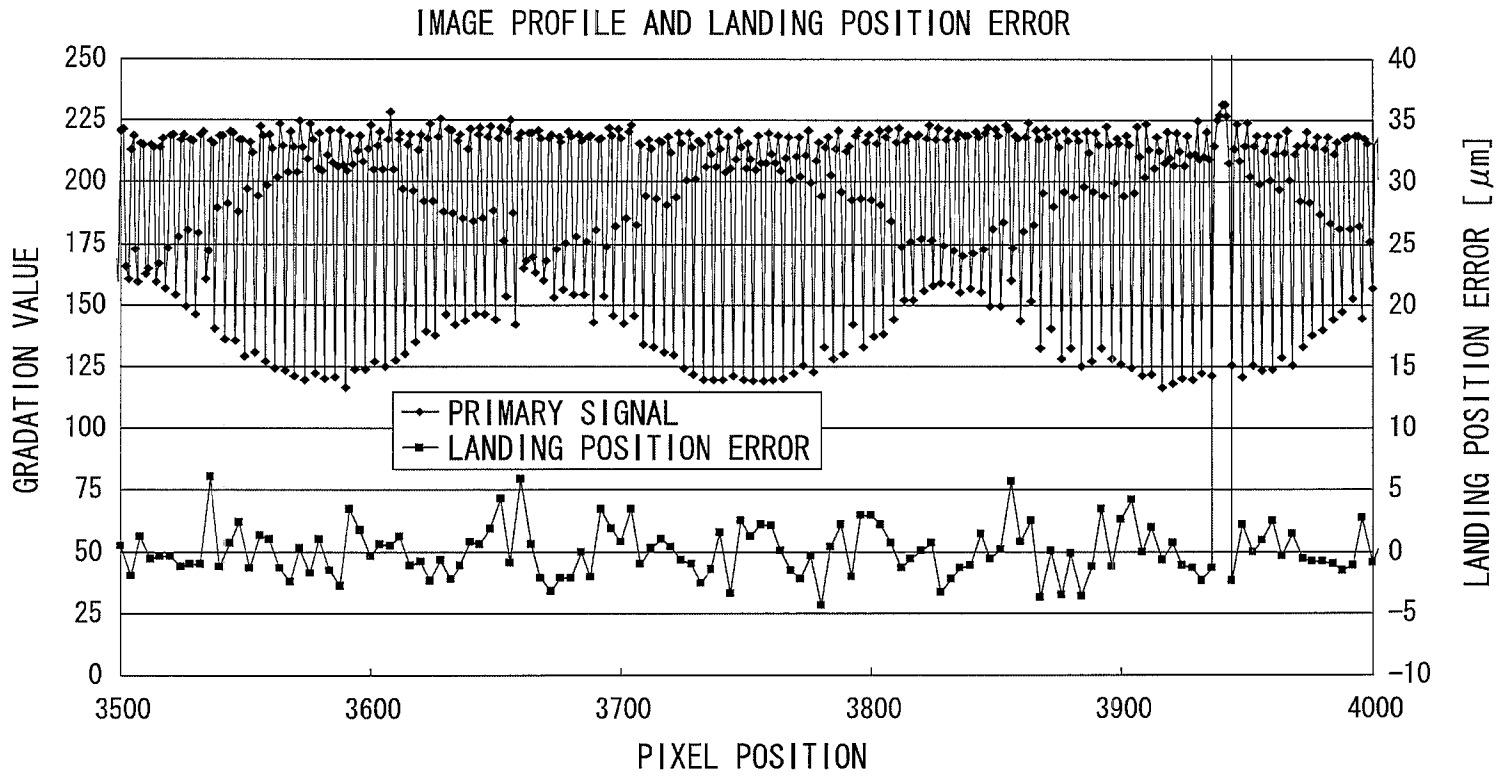
FIG. 18 is a graph showing an example of a read image profile of a line block.

FIG. 18 is a diagram showing a result of reading a 1-on 9-off line pattern printed by the head 50 having nozzles 51 with a print resolution of 1200 [DPI] using the test pattern reading unit 136 with a read resolution of 477 [DPI], and shows a primary signal of a read gradation value when a reading pixel position ranges from 3500 to 4000. In addition, FIG. 18 also shows an actual landing position error of each line.

In the example shown in FIG. 18, nozzles with large landing position errors exist near reading pixel positions of 3540, 3660, and 3850. In addition, a non-ejection nozzle exists near a reading pixel position of 3950.

Figure 19:
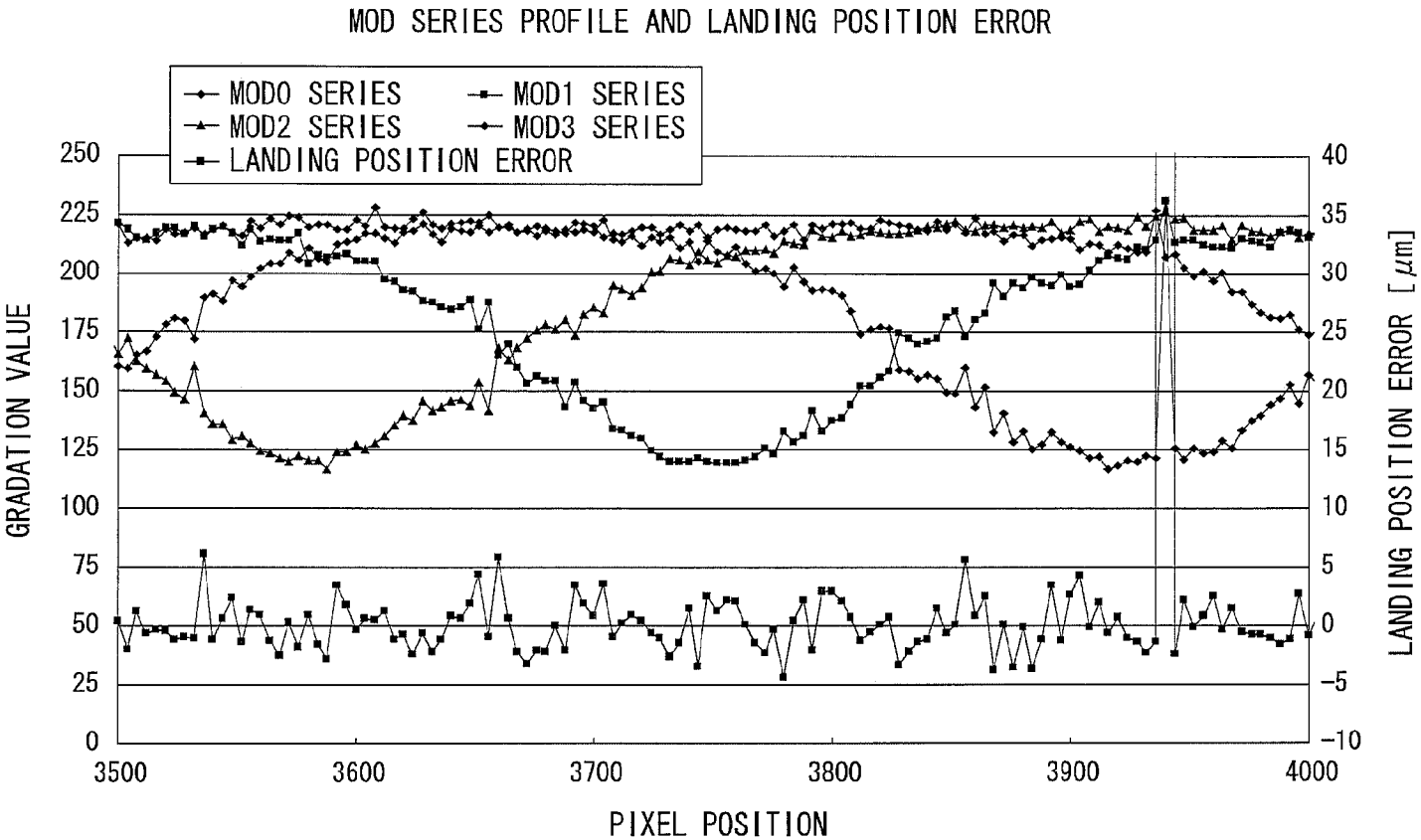
FIG. 19 is a graph showing a profile Isq per every MOD series.

FIG. 19 shows an example where PP=10, PS=4, WS=25400/477 [μm], and ΔP=1.33, and FIG. 18 shows a primary signal of a read gradation value when a reading pixel position ranges from 3500 to 4000. In addition, FIG. 18 also shows an actual landing position error of each line.

FIG. 19 is a graph showing the profile Isq per every MOD series when PP=10 and PS =4 with respect to read results shown in FIG. 18. As is apparent from FIG. 19, the profile Isq per every MOD series varies with a long periodicity. As shown in FIG. 17B, the period T is 159 [pixels].

Description of Processing for Determining Fluctuation Signal

Next, specific processing for determining a fluctuation signal from the profile Isq per every MOD series will be described.

First, an ideal profile ILsq (corresponding to a "predicted prediction signal") per every MOD series is obtained from the profile Isq per every MOD series.

Simple methods to obtain the ideal profile ILsq include applying a moving average or a low-pass filter (LPF) to the profile Isq per every MOD series. Alternatively, a polynomial approximation (N-th order polynomial) can be calculated at appropriate sectional intervals and a polynomial approximation corresponding to each section can be used. Next, as expressed by Formula 5 below, the ideal profile ILsq per every MOD series obtained above is subtracted from the profile Isq per every MOD series to determine a fluctuation signal IHsq per every MOD series.

$$IHsq(sq)=Isq(sq)-ILsq(sq)(\text{where } q\equiv x \bmod PS) \quad \text{Formula 5}$$

Figure 20:
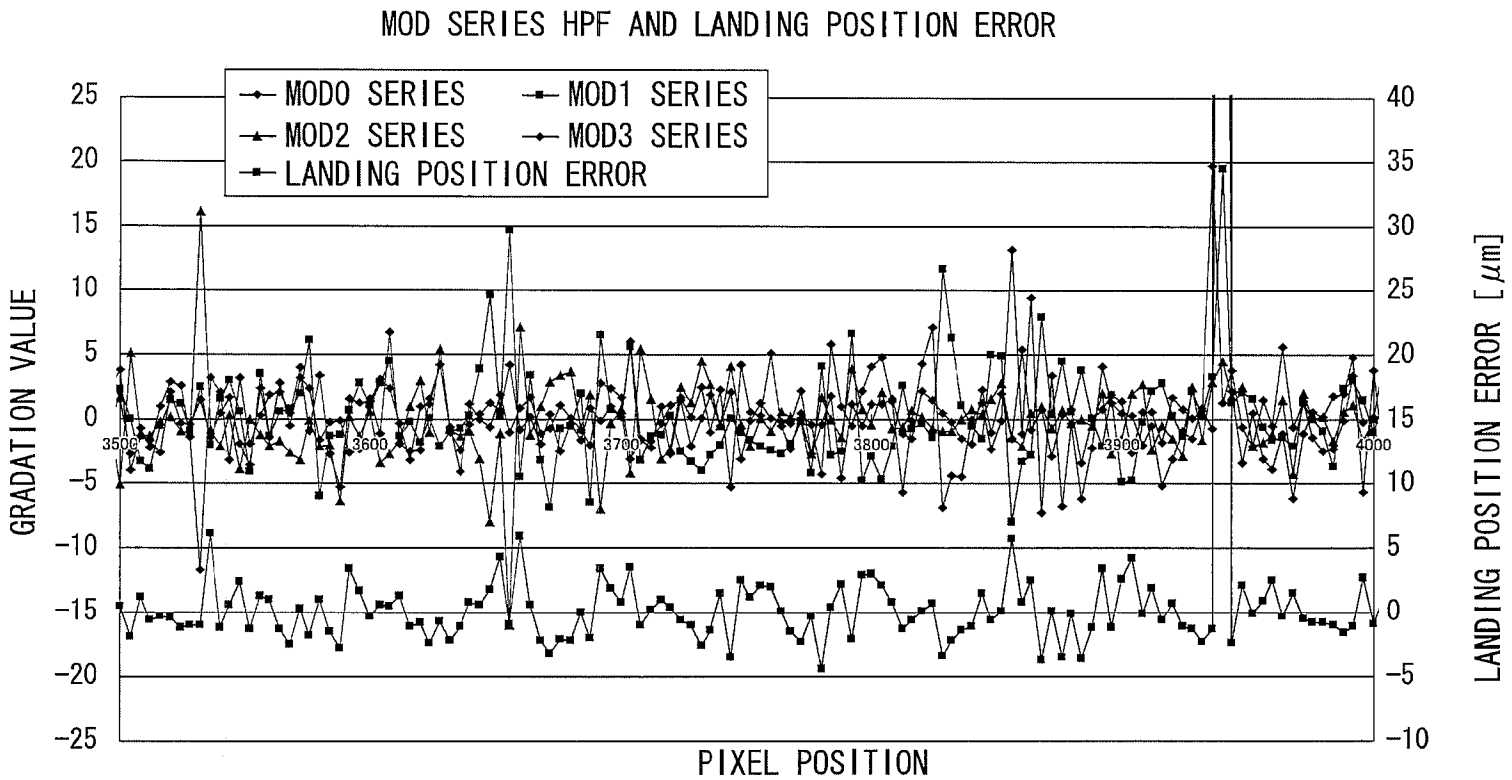
FIG. 20 is a graph showing a fluctuation signal IHsq per every MOD series.

FIG. 20 is a graph showing a fluctuation signal IHsq per every MOD series which has been determined as described above from the profile Isq per every MOD series shown in FIG. 19.

Description of Processing for Determining Pixel Position of Defective Ejection Nozzle Next, a reading pixel position corresponding to a defective ejection nozzle is determined. The reading pixel position is determined by comparing the fluctuation signal IHsq per every MOD series determined from Formula 5 with a predetermined threshold.

Specifically, in accordance with a signal value i of the ideal profile ILsq, a threshold table THpe(i) that corresponds to landing position errors, a threshold table THde(i) that corresponds to non-ejections, and a threshold table THve(i) that corresponds to volume abnormalities are determined in advance. The threshold varies according to the signal value i of the ideal profile ILsq because a phase relationship between the detection pitch LP and the analysis pitch LS is not constant.

When each fluctuation signal IHsq and each threshold described above are compared with each other with respect to three profiles including Is0(x), Is1(x+1), and Is2(x+2) among which k is consistent, if any one of the following is satisfied, $$IHsq(sq)>THpe(ILsq(sql)) \quad \text{Formula 6}$$

$$IHsq(sq)>THde(ILsq(sq)) \quad \text{Formula 7}$$

$$IHsq(sq)>THve(ILsq(sq)) \quad \text{Formula 8}$$

then a nozzle at the reading pixel position can be identified as a defective ejection nozzle.

Moreover, among the plurality of qs, a q with the largest judgment threshold (high noise tolerance, high SN) may be used in the comparison with the threshold described above in order to reduce an influence of a noise component that is included in a read image.

For example, when a non-ejection judgment is performed, a q of a profile with a lowest density among qs in which k is consistent may be used for the comparison with the threshold.

Description of Processing for Determining Line Position in Units of Pixels

Next, processing for determining a position of each line 103 in units of reading pixels will be described.

Figure 21:
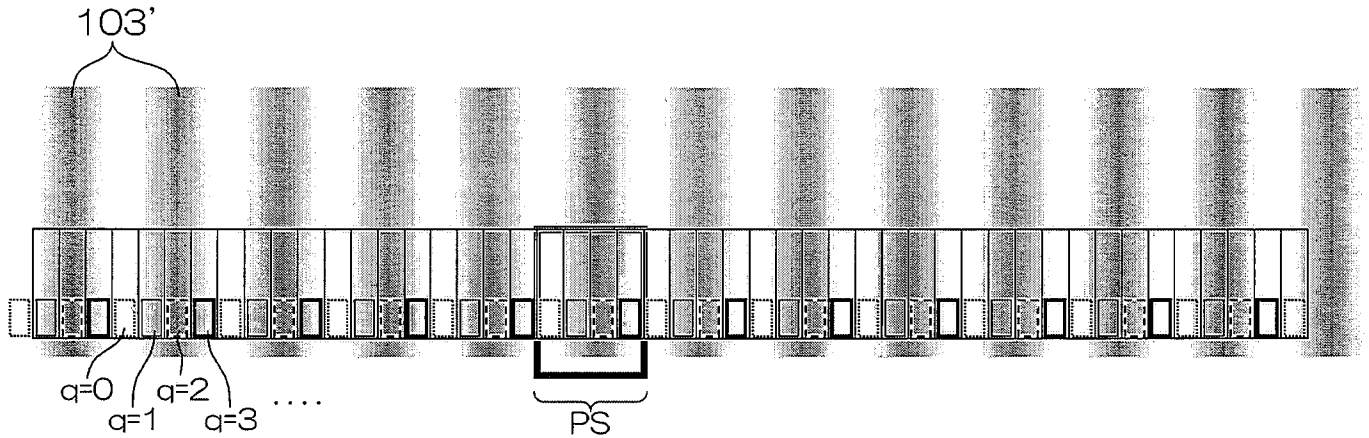
FIG. 21 is a diagram representing respective reading pixels, clusters of reading pixels, and read image profiles.

FIG. 21 is a diagram representing respective reading pixels, and bunches of reading pixels based on an analysis pitch unit PS=4. In addition, FIG. 21 shows read image profiles in a background in grayscale. A high density portion 103' in the background image corresponds to a position where a line 103 exists.

As shown in FIG. 21, an interval of the lines 103 is approximately consistent with bunches of reading pixels based on the analysis pitch unit PS. However, since phases of the detection pitch LP and the analysis pitch LS are not consistent with each other ($\Delta P\neq 0$), the lines 103 and the cluster of reading pixels gradually deviate from each other.

In order to determine a position of each line in units of reading pixels when such a deviation is generated, signal values (gradation values) of ideal profiles per every MOD series for which k is consistent may be compared by use of the ideal profile ILsq determined from the profile Isq per every MOD series, and q with a smallest signal value may be sequentially extracted.

For example, a minimum value among first four pixels (x=0 to 3, q=0 to 3) from an extreme end among the reading pixels is found and a position of x0 is assigned to that position. Next, with respect to the position x0 where the minimum value has been found, a minimum value is found from pixels ranging from x0+1 to x0+4, and a position of x1 is assigned to that position. Next, a minimum value is found from pixels ranging from x1+1 to x1+4 in the same manner, . . . and so on. In this manner, a reading pixel position xi and a line relative order i can be sequentially associated with each other.

As described above, even if the bunches of reading pixels according to the analysis pitch unit PS and the lines gradually deviate from each other, by sequentially extracting a reading pixel with a minimum signal value in analysis units PS, line positions and reading pixel positions can be associated with each other.

Consequently, a reading pixel position xi of a defective ejection nozzle and a line relative order i can be associated with each other. Therefore, by identifying a nozzle that has recorded the line, a defective ejection nozzle can be identified.

Defective Ejection Nozzle Detection Flow

Next, a specific method of identifying a defective ejection nozzle will be described.

Figure 23:
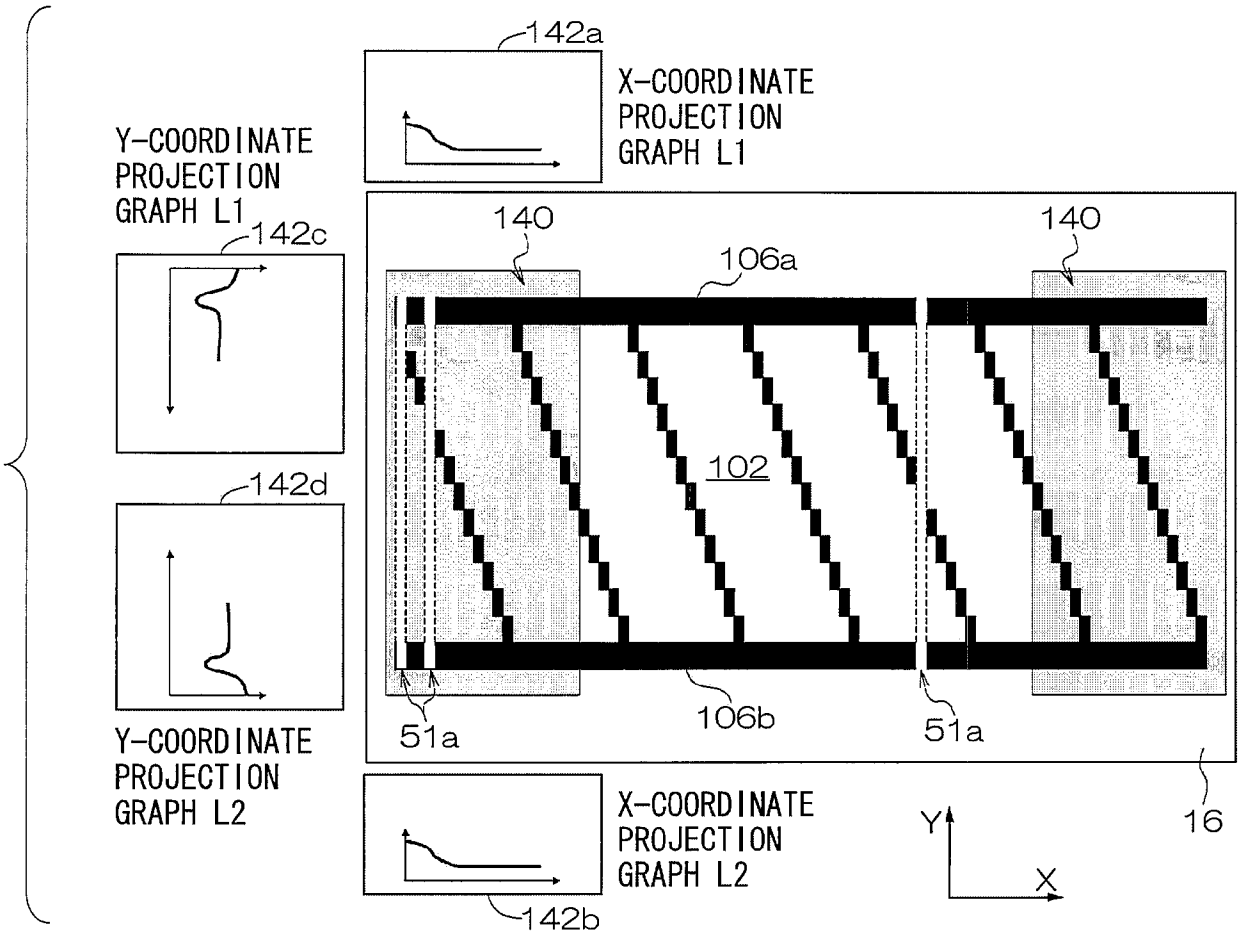
FIG. 23 is a diagram describing a method of detecting a reference position for line position identification from a read image.
Figure 24:
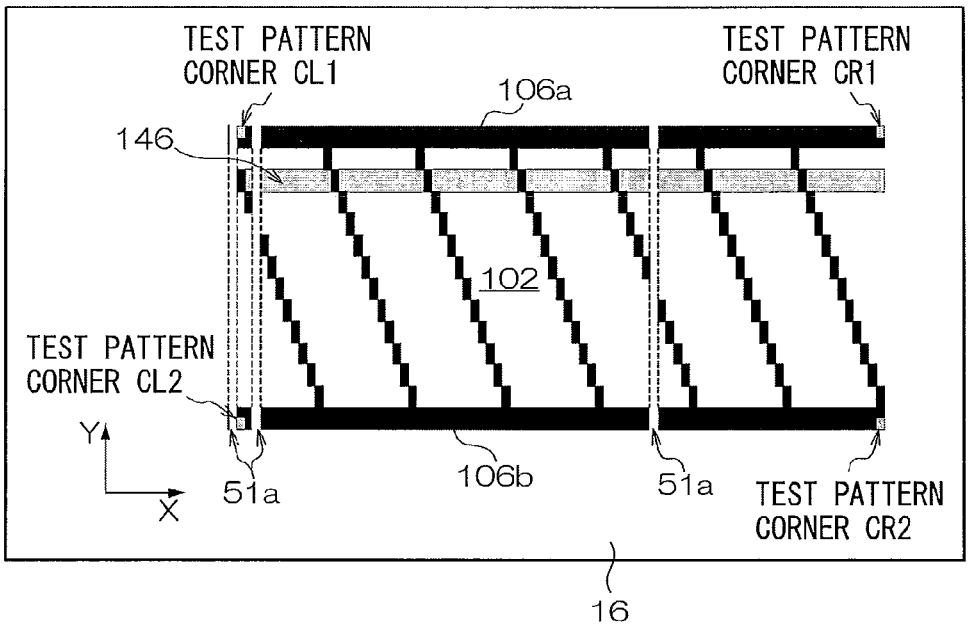
FIG. 24 is a diagram illustrating clipping of a line block of a nozzle based on a reference position.

FIG. 22 is a flow chart showing a flow of processing for detecting a defective ejection nozzle from a test pattern. FIG. 23 is a diagram describing a method of detecting a reference position for line position identification from a read image. FIG. 24 is a diagram describing clipping of a line block of a nozzle based on a reference position.

The test pattern 102 printed on the recording paper 16 by nozzles of the recording head is read as image data by the test pattern reading unit 136 (refer to FIG. 3) and read image data of the test pattern 102 is generated (S20 in FIG. 22). As an example, a read condition of the test pattern 102 in this case is set to 500 DPI in the X-direction (main scanning direction) and 100 DPI in the Y-direction (sub scanning direction).

Subsequently, a reference position (reference position detection bars 106*a* and 106*b*) used when identifying a line position of each test pattern 102 is determined from read image data of the test pattern 102 (S22 in FIG. 22).

Description of Processing for Determining Reference Position

Specifically, as shown in FIG. 23, reference position detection windows 140 each of which is a rectangular area which always includes an end of the test pattern 102 are respectively set at both ends (left and right ends in the X-direction) of the test pattern 102. At this point, with respect to a read image (RGB color), it is assumed that a position of the test pattern 102 in the read image is identified to some extent from a positional relationship between the test pattern 102, the recording paper 16, and the reading apparatus (the test pattern reading unit 136 shown in FIG. 3). The reference position detection windows 140 are set so as to always include one of the ends of the test pattern 120 in regards to a test pattern position range that is known to some extent.

Subsequently, the reference position detection window 140 is longitudinally divided into two areas and, in each area, X-direction and Y-direction optical density projection graphs 142*a* to 142*d* (an X-coordinate projection graph L1, an X-coordinate projection graph L2, a Y-coordinate projection graph L1, a Y-coordinate projection graph L2, an X-coordinate projection graph R1, an X-coordinate projection graph R2, a Y-coordinate projection graph R1, and a Y-coordinate projection graph R2) are created. In this case, the X-coordinate projection graph L1 (142*a*) and the Y-coordinate projection graph L1 (142*c*) represent projection graphs of an upper area of the reference position detection window 140 on a left-end side of FIG. 23. In a similar manner, the X-coordinate projection graph L2 (142*b*) and the Y-coordinate projection graph L2 (142*d*) represent projection graphs of a lower area of the reference position detection window 140. Furthermore, although not shown, projection graphs of the upper area of the reference position detection window 140 on a right-end side are referred to as the X-coordinate projection graph R1 and the Y-coordinate projection graph R1, and projection graphs of the lower area of the reference position detection window 140 on the right-end side are referred to as the X-coordinate projection graph R2 and the Y-coordinate projection graph R2. These projection graphs are created for each of the RGB colors and an X (Y) coordinate projection graph with a highest contrast is used. Hereinafter, it is assumed that calculation are performed on a color image plane with a highest contrast.

The Y-coordinate projection graph L1 will be described as an example. The Y-coordinate projection graph L1 is created by averaging, in an X-axis direction, a density gradation value in an upper part of a left end-side rectangular area (the reference position detection window 140). The rectangular area includes a blank part of paper, the first reference position detection bar 106*a* of the test pattern 102, and each linear test pattern 102. Therefore, sections respectively representing a blank part (white), the first reference position detection bar 106*a* (high density), and a line part (low density) line up in sequence in the Y-coordinate projection graph L1 (142*c*). Consequently, a left-side upper end Y-coordinate of the first reference position detection bar 106*a* can be obtained by detecting an edge that changes from white to a high density.

In addition, the X-coordinate projection graph L1 (142*a*) is created by averaging, in a Y-axis direction, a density gradation value in the upper part of the left end-side rectangular area (the reference position detection window 140). The rectangular area includes a blank part of paper and the first reference position detection bar 106*a* of the test pattern 102 (as well as linear test patterns 102 overlapping the first reference position detection bar 106*a*). Therefore, sections respectively representing a blank part (white), the first reference position detection bar, and a line part (high density) line up in sequence in the X-coordinate projection graph L1 (142*a*). Consequently, a left-side upper end X-coordinate of the first reference position detection bar 106*a* can be obtained by detecting an edge that changes from white to a high density.

Other projection graphs can be analyzed in a similar manner. As a result, XY-coordinates of respective corners (test pattern corners CL1, CL2, CR1, and CR2) of the first reference position detection bar 106*a* and a second reference position detection bar 106*b* as shown in FIG. 24 can be obtained. The test pattern corners CL1, CL2, CR1, and CR2 are used as reference positions.

Moreover, even if the head 50 includes a non-ejection nozzle and the first reference position detection bar 106*a* and the second reference position detection bar 106*b* are printed by a nozzle group including the non-ejection nozzle, since the first reference position detection bar 106*a* and the second reference position detection bar 106*b* are solid portions that are continuous in the X-direction (nozzle direction) and the Y-direction, the non-ejection nozzle has only a small effect on a position detection result of a print location 51*a* corresponding to the defective ejection nozzle (non-ejection nozzle). In addition, by analyzing RGB color with respect to each portion of the first reference position detection bar 106*a* and the second reference position detection bar 106*b*, a corresponding ink can be determined.

Description of Processing for Determining Position of Each Line Block

Next, a position of each line block 146 is obtained from the test pattern corners CL1, CL2, CR1, and CR2 that are reference positions (S24 in FIG. 22). As shown in FIG. 24, each line block 146 is constituted by a group of lines aligned at an approximately constant interval in the X-direction. Line blocks 146 that are adjacent to each other in the Y-direction are printed by ink drops from nozzles that are adjacent to each other in an alignment of nozzles in a single row (projected nozzle alignment). Therefore, each line in the test pattern 102 is assigned to any of line blocks 146 sequentially aligned in the Y-direction. First, an angle of rotation and X-direction and Y-direction magnification errors (a deviation between an actual magnification and a design magnification) of the test pattern 102 are calculated from a positional relationship among the test pattern corners CL1, CL2, CR1, and CR2. Since a layout of the test pattern 102 is known information, a position of the line block 146 (relative positions from the test pattern corners CL1, CL2, CR1, and CR2, and coordinates of four corners of a rectangle) is obtained based on known test pattern design information (for example, an X-direction pitch, a Y-direction pitch, an X-direction width, a Y-direction length, and the like, of the test pattern 102). A relative position of each line block 146 on a read image is calculated from the test pattern corner CL1 based on the magnification errors and the angle of rotation obtained beforehand. At this point, even if there is a location 51*a* that is printed by a defective ejection nozzle, since the first reference position detection bar 106*a* and the second reference position detection bar 106*b* are hardly affected by the location 51*a* that corresponds to the defective ejection nozzle, a position of the line block 146 can be accurately calculated. In this manner, positions of all line blocks 146 are identified.

Description of Processing for Identifying Defective Ejection Nozzle

A fluctuation signal is determined from a read signal of each line block 146 (S26 in FIG. 22).

As described earlier, the fluctuation signal is determined by decomposing (dividing) a profile of a read image signal based on a remainder q of a division of the reading pixel position x by the analysis pitch unit PS, and analyzing the decomposed profile per every MOD-series.

Next, a reading pixel position of a defective ejection nozzle is determined (S28). In other words, by comparing the fluctuation signal IHsq determined in S26 with a predetermined threshold, a reading pixel position corresponding to a defective ejection nozzle is determined.

Next, a line position is determined in units of pixels (S30), and based on a relationship between the line position and the reference position determined in step S22, a nozzle number (nozzle position) of each line is sequentially identified (S32).

Finally, each identified line position and the pixel position of the defective ejection nozzle are associated with each other and a defective ejection nozzle number (defective ejection nozzle position) is identified (S34).

As shown, according to the present embodiment, a defective recording element can be accurately identified even when using a reading device having a lower resolution than a recording head.

The method of identifying a defective ejection nozzle according to the present embodiment is particularly effective when a width (X-direction width) of the line 103 is approximately equal to the reading pixel pitch WS of the test pattern reading unit 136 in the X-direction. In addition, a defective ejection nozzle can be appropriately identified when the width of the line 103 is equal to or greater than 0.5 times WS.

Moreover, if a line width of a test pattern is greater than the reading pixel pitch means, the reading is being performed at relatively high resolution. Therefore, cases where the present embodiment that is intended for use of a low-resolution scanner are cases when a line width is equal to or smaller than approximately twice the reading pixel pitch.

Next, an example of an image forming apparatus including an image correcting function which uses the aforementioned detecting function of a defective ejection nozzle and a detection result thereof will be described.

Description of Inkjet Recording Apparatus

Figure 25:
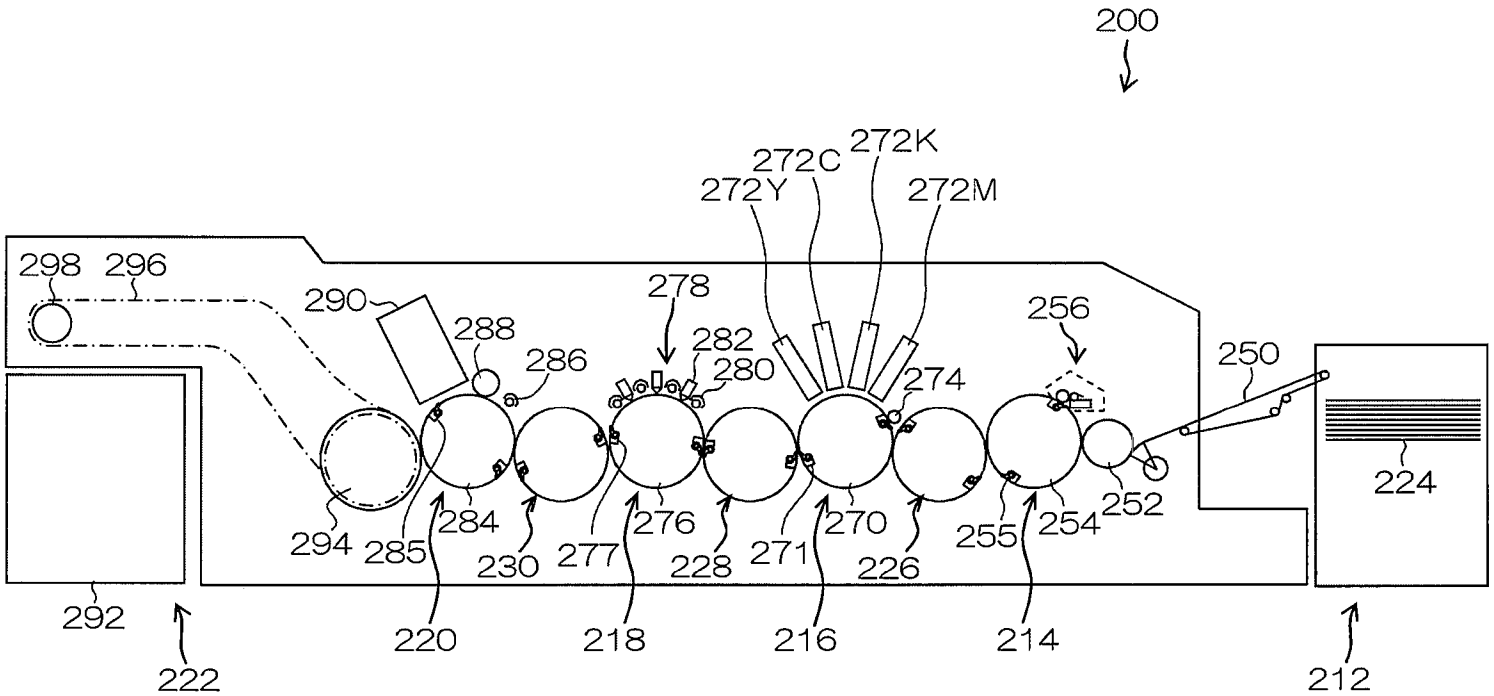
FIG. 25 is an overall configuration diagram of an inkjet recording apparatus according to an embodiment of the present invention.

FIG. 25 is a diagram showing a configuration example of an inkjet recording apparatus 200 according to an embodiment of the present invention. The inkjet recording apparatus 200 primarily includes a paper supply unit 212, a treatment liquid deposition unit 214, a rendering unit 216, a drying unit 218, a fixing unit 220, and a discharging unit 222. The inkjet recording apparatus 200 is an on-demand drop type image forming apparatus which deposits ink of a plurality of colors from inkjet heads (corresponding to "rendering heads") 272M, 272K, 272C, and 272Y onto a recording medium 224 (hereinafter, sometimes referred to as "paper" for convenience) held on an impression cylinder (rendering drum 270) of a rendering unit 216 to form a desired color image.

Paper Supply Unit

The recording media 224 that are sheets of paper are stacked in the paper supply unit 212. The recording medium 224 is supplied one sheet at a time from a paper supply tray 250 of the paper supply unit 212 to the treatment liquid deposition unit 214. While sheets of paper (cut paper) are used as the recording media 224 in the present example, a configuration can also be adopted in which continuous-form paper (a roll of paper) is cut down to a necessary size and then supplied.

Treatment Liquid Deposition Unit

The treatment liquid deposition unit 214 is a mechanism which deposits treatment liquid onto a recording surface of the recording medium 224. The treatment liquid includes a coloring material aggregating agent which aggregates the coloring material (in the present embodiment, the pigment) in the ink deposited by the rendering unit 216, and the separation of the ink into the coloring material and the solvent is promoted due to the treatment liquid and the ink making contact with each other.

The treatment liquid deposition unit 214 includes a paper supply drum 252, a treatment liquid drum 254 and a treatment liquid application apparatus 256. The treatment liquid drum 254 includes a hook-shaped holding device (gripper) 255 provided on the outer circumferential surface thereof, and is devised in such a manner that the leading end of a recording medium 224 can be held by gripping the recording medium 224 between the hook of the holding device 255 and the circumferential surface of the treatment liquid drum 254. The treatment liquid drum 254 may include suction holes provided in the outer circumferential surface thereof, and be connected to a suctioning device which performs suctioning via the suction holes. By this means, it is possible to hold the recording medium 224 tightly against the circumferential surface of the treatment liquid drum 254.

A treatment liquid application apparatus 256 is provided opposing the circumferential surface of the treatment liquid drum 254, in the outside of the drum. The treatment liquid application apparatus 256 includes a treatment liquid vessel in which treatment liquid is stored, an anilox roller which is partially immersed in the treatment liquid in the treatment liquid vessel, and a rubber roller which transfers a dosed amount of the treatment liquid to the recording medium 224, by being pressed against the anilox roller and the recording medium 224 on the treatment liquid drum 254. According to this treatment liquid application apparatus 256, it is possible to apply treatment liquid to the recording medium 224 while dosing the amount of the treatment liquid. In the present embodiment, a composition is described which uses a roller-based application method, but the method is not limited to this, and it is also possible to employ various other methods, such as a spray method, an inkjet method, or the like.

The recording medium 224 onto which treatment liquid has been deposited by the treatment liquid deposition unit 214 is transferred from the treatment liquid drum 254 to the rendering drum 270 of the rendering unit 216 via the intermediate conveyance unit 226.

Rendering Unit

The rendering unit 216 includes a rendering drum 270, a paper pressing roller 274, and inkjet heads 272M, 272K, 272C and 272Y. Similarly to the treatment liquid drum 254, the rendering drum 270 includes a hook-shaped holding device (gripper) 271 on the outer circumferential surface of the drum. The rendering drum 270 according to the present example is configured so that grippers 271 are provided at two locations on a peripheral surface at 180 degree intervals with respect to a direction of the rotation and two sheets of the recording medium 224 can be conveyed by one rotation.

A large number of suction holes, not shown, are formed in a predetermined pattern on the peripheral surface of the rendering drum 270. As air is sucked inward through the suction holes, the recording medium 224 is suctioned and held onto the peripheral surface of the rendering drum 270. Moreover, in addition to a configuration in which the recording medium 224 is suctioned and held by negative pressure suction, for example, a configuration in which the recording medium 224 is suctioned and held by electrostatic adsorption can also be adopted.

The inkjet heads 272M, 272K, 272C and 272Y are each full-line type inkjet rendering heads having a length corresponding to the maximum width of the image forming region on the recording medium 224, and a nozzle row of nozzles for ejecting ink arranged throughout the whole width of the image forming region is formed in the ink ejection surface of each head. The inkjet heads 272M, 272K, 272C and 272Y are disposed so as to extend in a direction perpendicular to the conveyance direction of the recording medium 224 (the direction of rotation of the rendering drum 270).

When droplets of the corresponding colored ink are ejected from the inkjet heads 272M, 272K, 272C and 272Y toward the recording surface of the recording medium 224 which is held tightly on the rendering drum 270, the ink makes contact with the treatment liquid which has previously been deposited onto the recording surface by the treatment liquid deposition unit 214, the coloring material (pigment) dispersed in the ink is aggregated, and a coloring material aggregate is thereby formed. By this means, flowing of coloring material, and the like, on the recording medium 224 is prevented and an image is formed on the recording surface of the recording medium 224.

The recording medium 224 is conveyed at a uniform speed by the rendering drum 270, and it is possible to record an image on an image forming region of the recording medium 224 by performing just one operation of moving the recording medium 224 and the inkjet heads 272M, 272K, 272C and 272Y relatively in the conveyance direction (in other words, by a single sub-scanning operation). This single-pass type image formation with such a full line type (page-wide) head can achieve a higher printing speed compared with a case of a multi-pass type image formation with a serial (shuttle) type of head which moves back and forth reciprocally in the direction (the main scanning direction) perpendicular to the conveyance direction of the recording medium (sub-scanning direction), and hence it is possible to improve the print productivity.

Although the configuration with the CMYK standard four colors is described in the present embodiment, combinations of the ink colors and the number of colors are not limited to the embodiment described above. As required, light inks, dark inks and/or special color inks can be added. For example, a configuration in which inkjet heads for ejecting light-colored inks such as light cyan and light magenta are added is possible. Moreover, there are no particular restrictions on the sequence in which the heads of respective colors are arranged.

The recording medium 224 onto which an image has been formed in the rendering unit 216 is transferred from the rendering drum 270 to the drying drum 276 of the drying unit 218 via the intermediate conveyance unit 228.

Drying Unit

The drying unit 218 is a mechanism which dries the water content contained in the solvent which has been separated by the action of aggregating the coloring material, and includes a drying drum 276 and a solvent drying apparatus 278. Similarly to the treatment liquid drum 254, the drying drum 276 includes a hook-shaped holding device (gripper) 277 provided on the outer circumferential surface of the drum. The solvent drying apparatus 278 is disposed in a position opposing the outer circumferential surface of the drying drum 276, and is constituted by a plurality of halogen heaters 280 and hot air spraying nozzles 282 disposed respectively between the halogen heaters 280. It is possible to achieve various drying conditions, by suitably adjusting the temperature and air flow volume of the hot air flow which is blown from the hot air flow spraying nozzles 282 toward the recording medium 224, and the temperatures of the respective halogen heaters 280. The recording medium 224 on which a drying process has been carried out in the drying unit 218 is transferred from the drying drum 276 to the fixing drum 284 of the fixing unit 220 via the intermediate conveyance unit 230.

Fixing Unit

The fixing unit 220 is constituted by a fixing drum 284, a halogen heater 286, a fixing roller 288 and an in-line sensor 290. Similarly to the treatment liquid drum 254, the fixing drum 284 includes a hook-shaped holding device (gripper) 285 provided on the outer circumferential surface of the drum.

By means of the rotation of the fixing drum 284, the recording medium 224 is conveyed with the recording surface facing to the outer side, and preliminary heating by the halogen heater 286, a fixing process by the fixing roller 288 and inspection by the in-line sensor 290 are carried out in respect of the recording surface.

The fixing roller 288 is a roller member for melting self-dispersing polymer micro-particles contained in the ink and thereby causing the ink to form a film, by applying heat and pressure to the dried ink, and is composed so as to heat and pressurize the recording medium 224. More specifically, the fixing roller 288 is disposed so as to press against the fixing drum 284, in such a manner that a nip is created between the fixing roller and the fixing drum 284. By this means, the recording medium 224 is sandwiched between the fixing roller 288 and the fixing drum 284 and is nipped with a prescribed nip pressure (for example, 0.15 MPa), whereby a fixing process is carried out.

Furthermore, the fixing roller 288 is constituted by a heating roller formed by a metal pipe, such as an aluminum pipe, having good thermal conductivity, which internally incorporates a halogen lamp, and is controlled to a prescribed temperature (for example, 60° C. to 80° C.). By heating the recording medium 224 by means of this heating roller, thermal energy equal to or greater than the Tg temperature (glass transition temperature) of the latex contained in the ink is applied and the latex particles are thereby caused to melt. By this means, fixing is performed by pressing the latex particles into the undulations in the recording medium 224, as well as leveling the undulations in the image surface and obtaining a glossy finish.

On the other hand, the in-line sensor 290 is a measuring device which measures an ejection failure check pattern, an image density, a defect in an image, and the like of an image (including a test pattern for non-ejection detection, a test pattern for density correction, and a printed image) recorded on the recording medium 224. A CCD line sensor, or the like, is applied as the in-line sensor 290. The in-line sensor 290 corresponds to the test pattern reading unit described by reference numeral 136 in FIG. 3.

Instead of an ink which includes a high-boiling-point solvent and polymer micro-particles (thermoplastic resin particles), it is also possible to include a monomer which can be polymerized and cured by exposure to UV light. In this case, the inkjet recording apparatus 200 includes a UV exposure unit for exposing the ink on the recording medium 224 to UV light, instead of a heat and pressure fixing unit (fixing roller 288) based on a heat roller. In this way, if using an ink containing an active light-curable resin, such as an ultraviolet-curable resin, a device which irradiates the active light, such as a UV lamp or an ultraviolet LD (laser diode) array, is provided instead of the fixing roller 288 for heat fixing.

Paper Output Unit

A paper output unit 222 is provided subsequently to the fixing unit 220. The paper output unit 222 includes an output tray 292, and a transfer drum 294, a conveyance belt 296 and a tensioning roller 298 are provided between the output tray 292 and the fixing drum 284 of the fixing unit 220 so as to oppose same. The recording medium 224 is sent to the conveyance belt 296 by the transfer drum 294 and output to the output tray 292. The details of the paper conveyance mechanism created by the conveyance belt 296 are not shown, but the leading end portion of a recording medium 224 after printing is held by a gripper of a bar (not illustrated) which spans across the endless conveyance belt 296, and the recording medium is conveyed to above the output tray 292 due to the rotation of the conveyance belt 296.

Furthermore, although not shown in FIG. 25, the inkjet recording apparatus 200 according to the present embodiment includes, in addition to the composition described above, an ink storing and loading unit which supplies ink to the inkjet heads 272M, 272K, 272C and 272Y, and a device which supplies treatment liquid to the treatment liquid deposition unit 214, as well as including a head maintenance unit which carries out cleaning (nozzle surface wiping, purging, nozzle suctioning, nozzle cleaning and the like) of the inkjet heads 272M, 272K, 272C and 272Y, a position determination sensor which determines the position of the recording medium 224 in the paper conveyance path, a temperature sensor which determines the temperature of the respective units of the apparatus, and the like.

Structure of Inkjet Head

Next, the structure of inkjet heads is described. The respective inkjet heads 272M, 272K, 272C and 272Y have the same structure, and a reference numeral 350 is hereinafter designated to any of the heads.

Figure 26A:
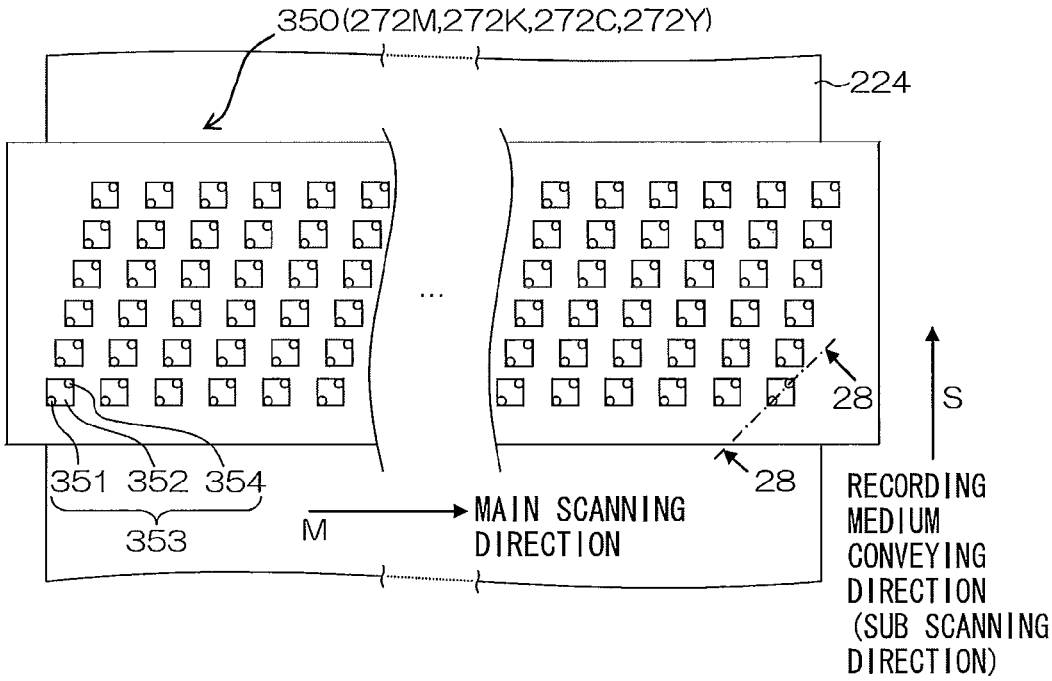
FIGS. 26A and 26B are plan perspective views showing a configuration example of an inkjet head.
Figure 26B:
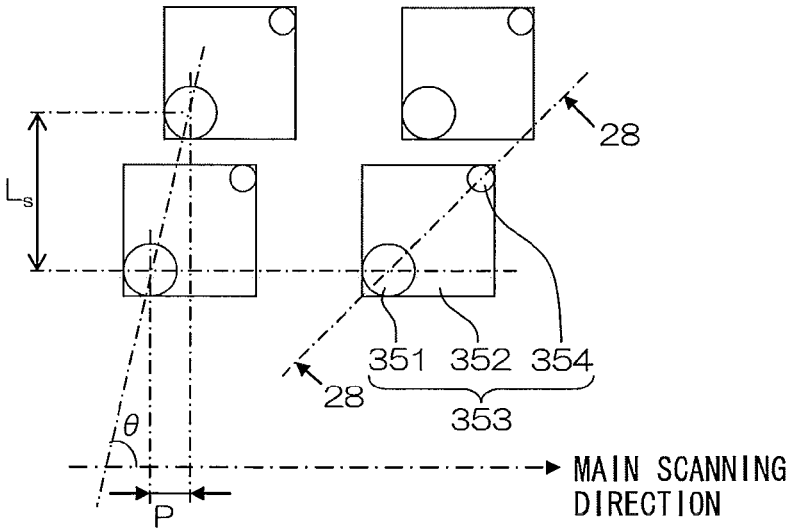
Figure 27A:
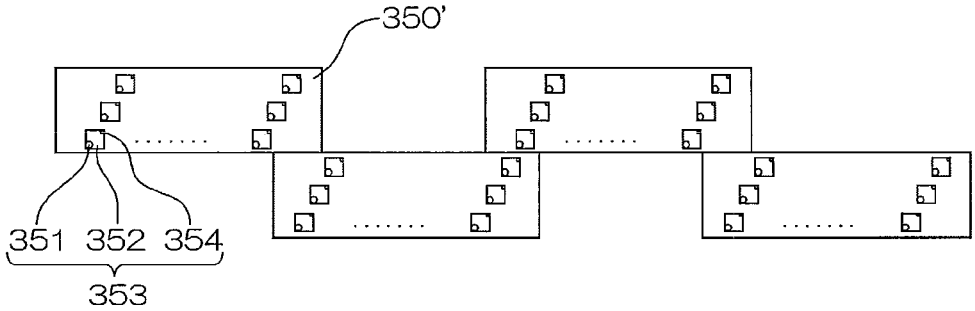
FIGS. 27A and 27B are diagrams showing examples of an inkjet head configured by coupling together a plurality of head modules.
Figure 27B:
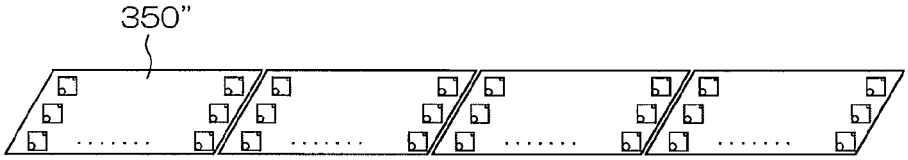
Figure 28:
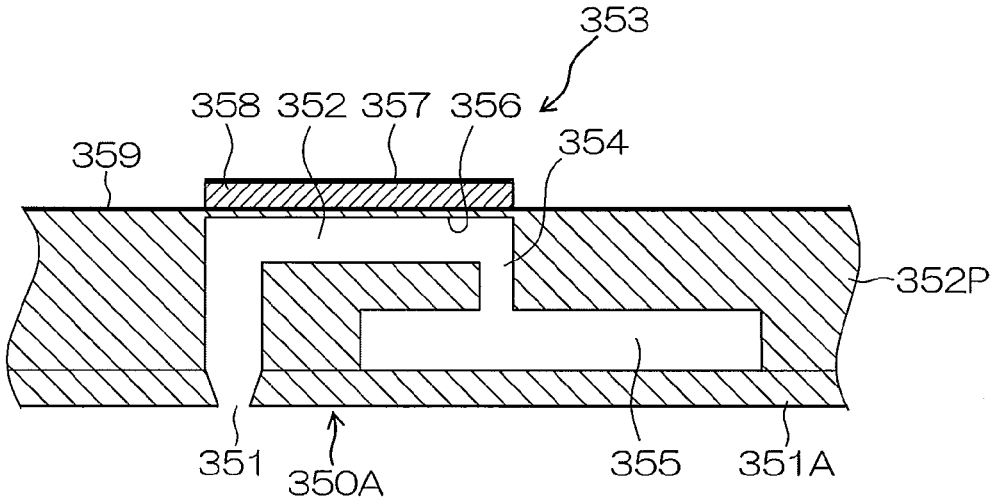
FIG. 28 is a cross-sectional view taken along line 28-28 in FIGS. 26A and 26B.

FIG. 26A is a plan perspective diagram illustrating an example of the structure of a head 350, and FIG. 26B is a partial enlarged diagram of same. FIGS. 27A and 27B each show an arrangement example of a plurality of head modules forming the head 350. Moreover, FIG. 28 is a cross-sectional diagram (a cross-sectional diagram along line 28-28 in FIGS. 26A and 26B) illustrating a structure of a liquid droplet ejection element for one channel being a recording element unit (ejection element unit).

As illustrated in FIGS. 26A and 26B, the head 350 according to the present embodiment has a structure in which a plurality of ink chamber units (liquid droplet ejection elements) 353, each having a nozzle 351 forming an ink droplet ejection aperture, a pressure chamber 352 corresponding to the nozzle 351, and the like, are disposed two-dimensionally in the form of a staggered matrix, and hence the effective nozzle interval (the projected nozzle pitch) as projected (orthographically-projected) in the lengthwise direction of the head (the direction perpendicular to the paper conveyance direction) is reduced and high nozzle density is achieved. In other words, an interval P (refer to FIG. 26B) between the projected nozzles when the nozzles 351 are projected on a straight line that is parallel to the main scanning direction can be treated as being equivalent to the recording pixel pitch WP described with reference to FIG. 9.

Moreover, in a case of a head such as the head 350 in which nozzles are two-dimensionally arranged, the detection unit (number of detection pitch) PP described with reference to FIG. 9 indicates a row of pixels including a predetermined number of printing pixels which are consecutively aligned with respect to the respective projected nozzles described above and bunched together to form a unit of detection. For example, in a case of forming the line 103 when detection unit PP=6 as shown in FIG. 9, projected nozzles per the detection unit PP=6 (projected nozzles at intervals of the detection unit PP) may be selected from the respective projected nozzles, whereby the line 103 can be formed using nozzles (projected source nozzles) corresponding to the selected projected nozzles.

In order to form a row of nozzles that is equal to or longer than a length accommodating an entire width of a rendering area of the recording medium 224 in a direction (a direction of an arrow M; corresponding to the "x-direction") which is approximately perpendicular to a feed direction (a direction of an arrow S; corresponding to the "y-direction") of the recording medium 224, for example, as shown in FIG. 27A, short head modules 350' having a plurality of nozzles 351 in a two-dimensional arrangement are disposed in a staggered pattern to form a long linear head. Alternatively, as shown in FIG. 27B, a mode can be adopted in which head modules 350" are aligned in a single row and then joined together.

Moreover, with a single-pass printing full-line print head, in addition to a case where an entire surface of the recording medium 224 is set as a rendering range, when a portion on the surface of the recording medium 224 is set as a rendering range, a row of nozzles necessary for rendering within a predetermined rendering area need only be formed.

The pressure chambers 352 provided with respect to the nozzles 351 respectively each have substantially a square planar shape (see FIGS. 26A and 26B), and each have an outlet port for the nozzle 351 at one of diagonally opposite corners and an inlet port (supply port) 354 for receiving the supply of the ink at the other of the corners. The planar shape of the pressure chambers 352 is not limited to this embodiment and can be various shapes including quadrangle (rhombus, rectangle, etc.), pentagon, hexagon, other polygons, circle, and ellipse.

As illustrated in FIG. 28, the head 350 is configured by stacking and joining together a nozzle plate 351A in which the nozzles 351 are formed, a flow channel plate 352P in which the pressure chambers 352 and the flow channels including the common flow channel 355 are formed, and the like. The nozzle plate 351A constitutes a nozzle surface (ink ejection surface) 350A of the head 350 and has formed therein a plurality of two-dimensionally arranged nozzles 351 communicating respectively to the pressure chambers 352.

The flow channel plate 352P constitutes lateral side wall parts of the pressure chambers 352 and serves as a flow channel formation member which forms a supply port 354 as a limiting part (the narrowest part) of the individual supply channel leading the ink from a common flow channel 355 to each of the pressure chambers 352. FIG. 28 is simplified for the convenience of explanation, and the flow channel plate 352P may be structured by stacking one or more substrates.

The nozzle plate 351A and the flow channel plate 352P can be made of silicon and formed in the required shapes by means of a semiconductor manufacturing process.

The common flow channel 355 is connected to an ink tank (not shown), which is a base tank for supplying ink, and the ink supplied from the ink tank is delivered through the common flow channel 355 to each of the pressure chambers 352.

A piezo-actuator (piezoelectric element) 358 having an individual electrode 357 is connected on a diaphragm 356 constituting a part of faces (the ceiling face in FIG. 28) of the pressure chamber 352. The diaphragm 356 in the present embodiment is made of silicon (Si) with a nickel (Ni) conductive layer serving as a common electrode 359 corresponding to lower electrodes of piezo-actuators 358, and also serves as the common electrode of the piezo-actuators 358 which are disposed on the respective pressure chambers 352. The diaphragm 356 can be formed by a non-conductive material such as resin; and in such a case, a common electrode layer made of a conductive material such as metal is formed on the surface of the diaphragm member. It is also possible that the diaphragm is made of metal (an electrically-conductive material) such as stainless steel (SUS), which also serves as the common electrode.

When a drive voltage is applied to the individual electrode 357, the piezo-actuator 358 is deformed, the volume of the pressure chamber 352 is thereby changed, and the pressure in the pressure chamber 352 is thereby changed, so that the ink inside the pressure chamber 352 is ejected through the nozzle 351. When the displacement of the piezo-actuator 358 is returned to its original state after the ink is ejected, new ink is refilled in the pressure chamber 352 from the common flow channel 355 through the supply port 354.

As illustrated in FIG. 26B, the plurality of ink chamber units 353 having the above-described structure are arranged in a prescribed matrix arrangement pattern in a row direction along the main scanning direction and a column direction oblique at a given angle of θ which is not orthogonal to the main scanning direction, and thereby the high density nozzle head is formed in the present embodiment. In this matrix arrangement, the nozzles 351 can be regarded to be equivalent to those substantially arranged linearly at a fixed pitch $P=L_s/\tan\theta$ along the main scanning direction, where $L_s$ is a distance between the nozzles adjacent in the sub-scanning direction.

In implementing the present invention, the mode of arrangement of the nozzles 351 in the head 350 is not limited to the embodiments in the drawings, and various nozzle arrangement structures can be employed. For example, instead of the matrix arrangement as described in FIGS. 26A and 26B, it is also possible to use a V-shaped nozzle arrangement, or an undulating nozzle arrangement such as zigzag configuration (W-shape arrangement) which repeats units of V-shaped nozzle arrangements.

The devices which generate pressure (ejection energy) applied to eject droplets from the nozzles in the inkjet head is not limited to the piezo-actuator (piezoelectric element), and can employ various pressure generation devices (ejection energy generation devices), such as heaters (heating elements) in a thermal system (which uses the pressure resulting from film boiling by the heat of the heaters to eject ink), electrostatic actuators, and various actuators in other systems. According to the ejection system employed in the head, the corresponding energy generation devices can be arranged in the flow channel structure body.

Description of Control System

Figure 29:
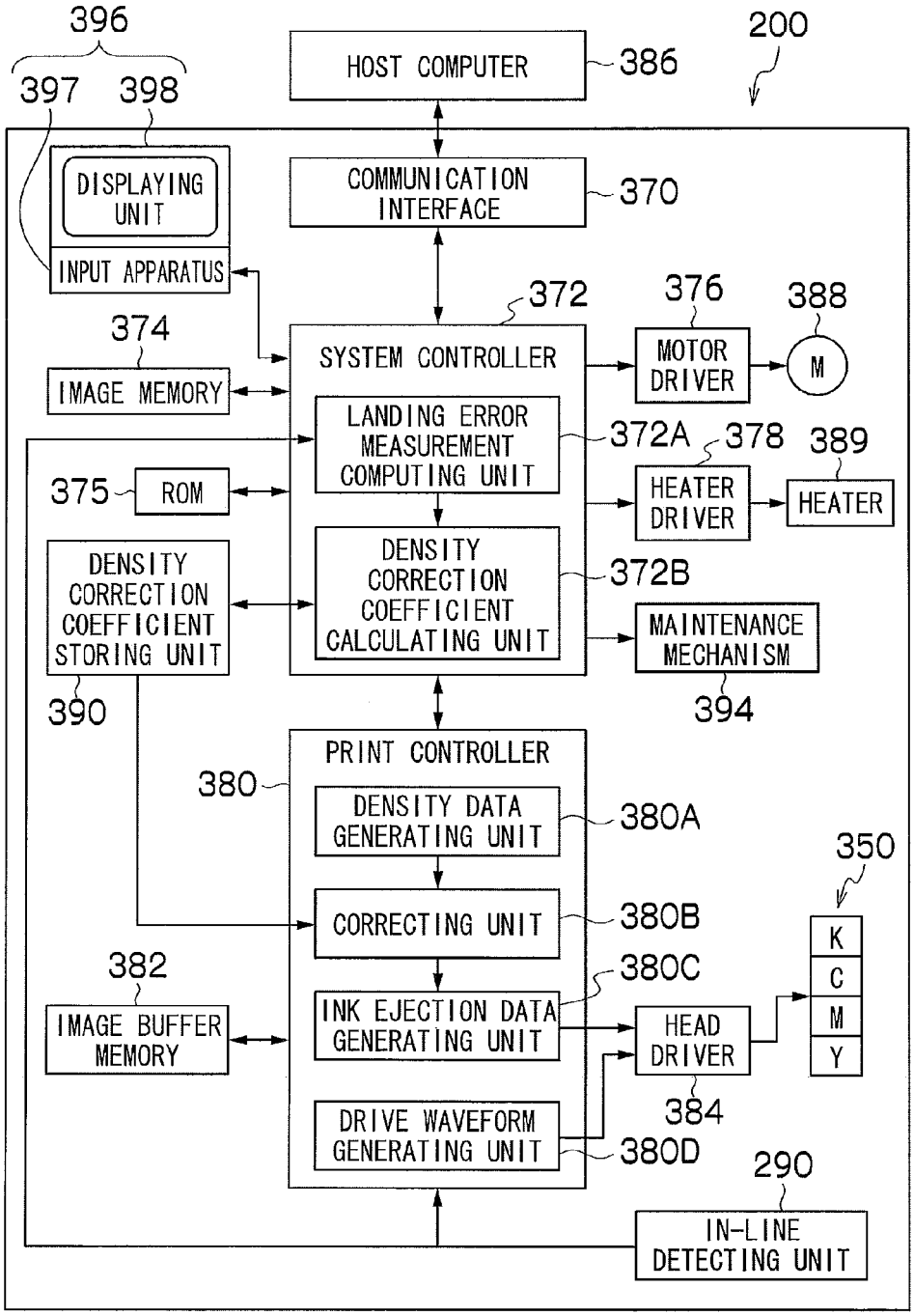
FIG. 29 is a block diagram showing a configuration of a control system of an inkjet recording apparatus.

FIG. 29 is a block diagram showing a system configuration of the inkjet recording apparatus 200. As shown in FIG. 29, the inkjet recording apparatus 200 includes a communication interface 370, a system controller 372, an image memory 374, a ROM 375, a motor driver 376, a heater driver 378, a print controller 380, an image buffer memory 382, a head driver 384 and the like.

The communication interface 370 is an interface unit (image input device) for receiving image data sent from a host computer 386. A serial interface such as USB (Universal Serial Bus), IEEE1394, Ethernet (registered trademark), and wireless network, or a parallel interface such as a Centronics interface may be used as the communication interface 370. A buffer memory (not shown) may be mounted in this portion in order to increase the communication speed.

The image data sent from the host computer 386 is received by the inkjet recording apparatus 200 through the communication interface 370, and is temporarily stored in the image memory 374. The image memory 374 is a storage device for storing images inputted through the communication interface 370, and data is written and read to and from the image memory 374 through the system controller 372. The image memory 374 is not limited to a memory composed of semiconductor elements, and a hard disk drive or another magnetic medium may be used.

The system controller 372 is constituted of a central processing unit (CPU) and peripheral circuits thereof, and the like, and it functions as a control device for controlling the whole of the inkjet recording apparatus 200 in accordance with a prescribed program, as well as a calculation device for performing various calculations. More specifically, the system controller 372 controls the various sections, such as the communication interface 370, image memory 374, motor driver 376, heater driver 378, and the like, as well as controlling communications with the host computer 386 and writing and reading to and from the image memory 374 and the ROM 375, and it also generates control signals for controlling the motor 388 of the conveyance system and the heater 389.

Furthermore, the system controller 372 includes a depositing error measurement and calculation unit 372A which performs calculation processing for generating data indicating the positions of defective nozzles, depositing position error data, data indicating the density distribution (density data) and other data from the image data read in from the test chart by the in-line sensor (in-line determination unit) 290, and a density correction coefficient calculation unit 372B which calculates density correction coefficients from the information relating to the measured depositing position error and the density information. The processing functions of the depositing error measurement and calculation unit 372A and the density correction coefficient calculation unit 372B can be achieved by means of an ASIC (application specific integrated circuit), software, or a suitable combination of same. Further, the system controller 372 functions as a means for analyzing the read image which has been described using FIG. 22. Specifically, the system controller 372 includes the defective ejection nozzle detecting unit 132 and the defective ejection nozzle determining unit 130. The density correction coefficient data obtained by the density correction coefficient calculation unit 372B is stored in a density correction coefficient storage unit 390.

The program executed by the CPU of the system controller 372 and the various types of data which are required for control procedures (including data for deposition to form the test chart for detecting defective ejection nozzles, information on defective ejection nozzles and the like) are stored in the ROM 375. A rewriteable storage device, such as an EEPROM, may be employed as the ROM 375. By utilizing the storage region of this ROM 375, the ROM 375 can be configured to be able to serve also as the density correction coefficient storage unit 390.

The image memory 374 is used as a temporary storage region for the image data, and it is also used as a program development region and a calculation work region for the CPU.

The motor driver (drive circuit) 376 drives the motor 388 of the conveyance system in accordance with commands from the system controller 372. The heater driver (drive circuit) 378 drives the heater 389 of the drying unit 218 and the like in accordance with commands from the system controller 372.

The print controller 380 is a control unit which functions as a signal processing device for performing various treatment processes, corrections, and the like, in accordance with the control implemented by the system controller 372, in order to generate a signal for controlling droplet ejection from the image data (multiple-value input image data) in the image memory 374, as well as functioning as a drive control device which controls the ejection driving of the head 350 by supplying the ink ejection data thus generated to the head driver 384.

In other words, the print controller 380 includes a density data generation unit 380A, a correction processing unit 380B, an ink ejection data generation unit 380C and a drive waveform generation unit 380D. These functional units (380A to 380D) can be realized by means of an ASIC, software or a suitable combination of same.

The density data generation unit 380A is a signal processing device which generates initial density data for the respective ink colors, from the input image data, and it carries out density conversion processing (including UCR processing and color conversion) and, where necessary, it also performs pixel number conversion processing.

The correction processing unit 380B is a processing device which performs density correction calculations using the density correction coefficients stored in the density correction coefficient storage unit 390, and it carries out the non-uniformity correction processing for eliminating an image defect attributable to a defective ejection nozzle or the like.

The ink ejection data generation unit 380C is a signal processing device including a halftoning device which converts the corrected image data (density data) generated by the correction processing unit 380B into binary or multiple-value dot data, and the ink ejection data generation unit 380C carries out binarization (multiple-value conversion) processing on the image data.

The ink ejection data generated by the ink ejection data generation unit 380C is supplied to the head driver 384, and the ink ejection operation of the head 350 is controlled accordingly.

The drive waveform generation unit 380D is a device for generating drive signal waveforms to drive the piezo-actuators 358 (see FIG. 28) corresponding to the respective nozzles 351 of the head 350. The signal (drive waveform) generated by the drive waveform generation unit 380D is supplied to the head driver 384. The signal outputted from the drive waveforms generation unit 380D may be digital waveform data, or it may be an analog voltage signal.

The drive waveform generating unit 380D selectively generates a recording waveform drive signal and an abnormal nozzle detection waveform drive signal. The various waveform data is stored in advance in a ROM 375 and, when needed, waveform data to be used is selectively outputted. The inkjet recording apparatus 200 described in the present example adopts a drive system in which a common driving power waveform signal is applied to each piezo-actuator 358 of a module that constitutes the head 350, and a switching element (not shown) connected to an individual electrode of each piezo-actuator 358 is turned on/off according to an ejection timing of each nozzle 351 to cause the nozzle 351 corresponding to each piezo-actuator 358 to eject ink.

The print controller 380 is provided with the image buffer memory 382 which temporarily stores data such as image data and parameters during image data processing performed by the print controller 380. While FIG. 29 shows a mode in which the image buffer memory 382 is attached to the print controller 380, the image memory 374 can be arranged to double as the image buffer memory 382. In addition, a mode can be adopted in which the print controller 380 and the system controller 372 are integrated and configured by a single processor.

To give a general description of the sequence of processing from image input to print output, image data to be printed is inputted from an external source through the communication interface 370, and is accumulated in the image memory 374. At this stage, multiple-value RGB image data is stored in the image memory 374, for example.

In this inkjet recording apparatus 200, an image which appears to have a continuous tonal graduation to the human eye is formed by changing the deposition density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 374 is sent to the print controller 380, through the system controller 372, and is converted to the dot data for each ink color by a half-toning technique, using dithering, error diffusion, or the like, by passing through the density data generation unit 380A, the correction processing unit 380B, and the ink ejection data generation unit 380C of the print controller 380.

Dot data is generally generated by performing color conversion and halftone processing on image data. The color conversion is processing for converting image data expressed as sRGB or the like (for example, RGB 8-bit image data) into color data of each color of ink used by an inkjet printer (in the present example, KCMY color data).

Halftone processing is processing for applying an error diffusion method, a threshold matrix method, and the like on color data of each color generated by the color conversion in order to convert the color data into dot data of each color (in the present example, KCMY dot data).

In other words, the print controller 380 performs processing for converting the input RGB image data into dot data for the four colors of K, C, M and Y. Processing for correcting ejection failure to correct an image defect attributable to a defective ejection nozzle is performed when the processing of conversion to dot data is carried out.

The dot data thus generated by the print controller 380 is stored in the image buffer memory 382. This dot data of the respective colors is converted into CMYK droplet ejection data for ejecting ink from the nozzles of the head 350, thereby establishing the ink ejection data to be printed.

The head driver 384 includes an amplifier circuit (power amplifier circuit) and outputs drive signals for driving the piezo-actuators 358 corresponding to the respective nozzles 351 of the head 350 in accordance with the print contents, on the basis of the ink ejection data and the drive waveform signals supplied by the print controller 380. A feedback control system for maintaining constant drive conditions in the head may be included in the head driver 384.

By supplying the drive signals outputted by the head driver 384 to the head 350 in this way, ink is ejected from the corresponding nozzles 351. By controlling ink ejection from the print head 350 in synchronization with the conveyance speed of the recording medium 224, an image is formed on the recording medium 224.

As described above, the ejection volume and the ejection timing of the ink droplets from the respective nozzles are controlled through the head driver 384, on the basis of the ink ejection data and the drive signal waveform generated by implementing required signal processing in the print controller 380. By this means, desired dot size and dot positions can be achieved.

As described with reference to FIG. 25, the in-line sensor (determination unit) 290 is a block including an image sensor which reads in the image printed on the recording medium 224, performs required signal processing operations, and the like, and determines the print situation (presence/absence of ejection, variation in droplet ejection, optical density, and the like), these determination results being supplied to the print controller 380 and the system controller 372.

The print controller 380 implements various corrections with respect to the head 350, on the basis of the information obtained from the in-line sensor (determination unit) 290, according to requirements, and it implements control for carrying out cleaning operations (nozzle restoring operations), such as preliminary ejection, suctioning, or wiping, as and when necessary.

The maintenance mechanism 394 in FIG. 29 includes members used for head maintenance operation, such as an ink receptacle, a suction cap, a suction pump, a wiper blade, and the like.

The operating unit 396 which forms a user interface is constituted of an input device 397 through which an operator (user) can make various inputs, and a display unit 398. The input device 397 may employ various formats, such as a keyboard, mouse, touch panel, buttons, or the like. The operator is able to input print conditions, select image quality modes, input and edit additional information, search for information, and the like, by operating the input device 397, and is able to check various information, such as the input contents, search results, and the like, through a display on the display unit 398. The display unit 398 also functions as a warning notification device which displays a warning message, or the like.

Moreover, the color converting unit 110, the non-ejection nozzle correction image processing unit 112, the halftone processing unit 114, the image memory 116, the image analyzing unit 124, the test pattern synthesizing unit 118, the head driver 128, the defective ejection nozzle determining unit 130, the defective ejection nozzle detecting unit 132, the defective nozzle information accumulating unit 126, the defective ejection correction determining unit 122, the correction information setting unit 120 and the like, which are described using FIG. 3, are configured as a single component or a combination of a plurality of components of the control system shown in FIG. 29.

The image memory 116, the head driver 128, and the head 50 shown in FIG. 3 correspond to the image memory 374, the head driver 384, and the head 350 shown in FIG. 29.

A combination of the system controller 372 and the print controller 380 shown in FIG. 29 functions as the "reference area setting means", the "comparison area setting means", the "correlation calculation means", the "distortion correction value determining means", the "image distortion correcting means", the "defective recording element judging means", the "interpolating means", the "analytical area setting means", the "histogram generating means", the "shading characteristics information generating means", the "shading correcting means", the "test pattern output control means", the "image correcting means", and the "recording control means".

It is also possible to adopt a mode in which the host computer 386 is equipped with all or a portion of the processing functions carried out by the depositing error measurement and calculation unit 372A, the density correction coefficient calculation unit 372B, the density data generation unit 380A and the correction processing unit 380B as shown in FIG. 29.

As described above, with the inkjet recording apparatus according to the present embodiment, since landing positions of ink drops ejected from each nozzle onto a recording paper can be accurately grasped by analyzing a read image of a test pattern, a position of a defective ejection nozzle can be identified with high accuracy. As a result, precise correction that compensates for an image defect attributable to a defective ejection nozzle can be performed on input image data. An overall processing flow based on the various processes described above will now be described.

Description of Image Printing Process

Figure 30:
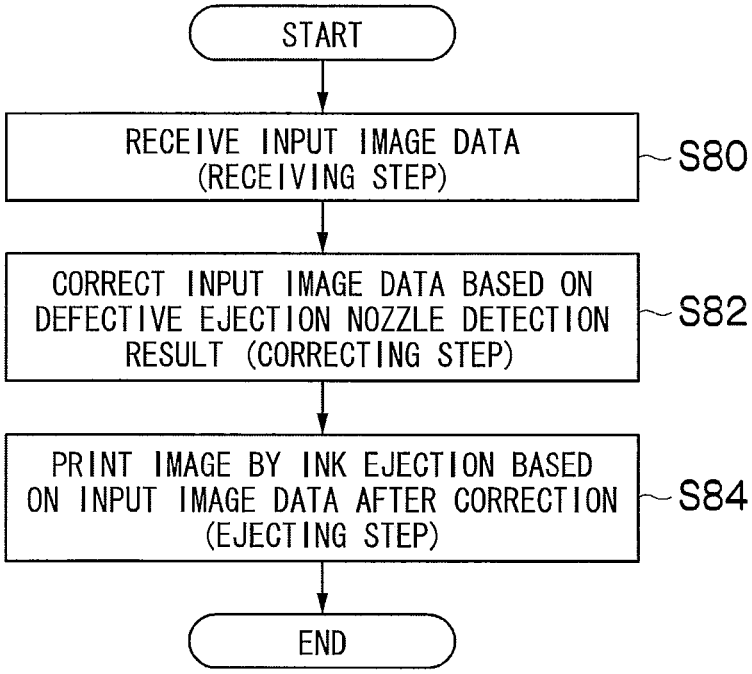
FIG. 30 is a flow chart showing a flow of image printing according to an embodiment.

FIG. 30 is a flow chart showing an entire flow of image printing. When input image data of a desired image that is sent from the host computer 386 (refer to FIG. 29) is received via the communication interface (receiving device) 370 (the receiving step shown as S80 in FIG. 38), the input image data is corrected (the correcting step shown as S82 in FIG. 30) through color conversion processing (the color converting unit 110 shown in FIG. 3), defective ejection nozzle correction processing (the non-ejection nozzle correction image processing unit 112), halftone processing (the halftone processing unit 114), and test pattern synthesis (the test pattern synthesizing unit 118), and the like.

Subsequently, based on the corrected input image data, by having the head driver 384 (reference numeral 128 in FIG. 3) cause ink drops to be ejected toward the recording medium 224 from a nozzle 351 of each head 350 (the ejection step shown as S84 in FIG. 30), a desired image can be vividly printed on the recording medium 224.

In the correcting step (S82) described above, ejection of ink drops from a defective ejection nozzle is compensated by another normal nozzle and, at the same time, defective ejection nozzle correction processing (non-ejection nozzle correction image processing unit 112) for preventing ink drops from being ejected from the defective ejection nozzle is performed on the input image data. The defective ejection nozzle correction processing is performed at the defective ejection nozzle detecting unit 132 (refer to FIG. 3) based on read image data of the test pattern 102 sent from the test pattern reading unit 136.

Moreover, there are various methods for performing ejection suspension on a defective ejection nozzle and compensating a rendering defect of the defective ejection nozzle by another nozzle, such as (1) a method of correcting an output image and (2) a method of increasing ejection signal strength and correcting an ejection dot diameter to a larger size.

(1) Method of Correcting Output Image

If $D^{default}$ denotes an image density of rendering in a periphery of a non-ejection correction nozzle, by setting an image density at the non-ejection correction nozzle to $D^{No\ Print}$ ($>D^{default}$), rendering density of the non-ejection correction nozzle can be increased and white noise visibility can be reduced. A ratio between the image densities can be defined as a non-ejection correction nozzle image density amplification amount $P^{density}$.

(2) Method of Increasing Ejection Signal and Increasing Ejection Dot Diameter

If $R^{default}$ denotes a dot diameter of rendering in a periphery of a non-ejection correction nozzle, by setting a dot diameter at the non-ejection correction nozzle to $R^{No\ Print}$ ($>R^{default}$) rendering density of the non-ejection correction nozzle can be increased and white noise visibility can be reduced. A ratio between the dot diameters can be defined as a non-ejection correction nozzle dot density amplification amount $P^{dot}$.

If amounts of increase of rendering by a non-ejection correction nozzle such as the non-ejection correction nozzle image density amplification amount $P^{density}$ and the non-ejection correction nozzle dot density amplification amount $P^{dot}$ in the two representative examples described above or similar compensation amounts are collectively defined as a non-ejection correction parameter P, then image correction is performed using the non-ejection correction parameter P.

Modification

A 1-on n-off line pattern has been exemplified as the test pattern 102. However, in addition to a line corresponding to a single nozzle, a pattern may be used in which band-like blocks or the like in which a plurality of (for example, two to three) lines are integrally combined are aligned approximately regularly.

Configuration Example Using Off-Line Scanner

While an example in which an in-line sensor 290 built into an inkjet recording apparatus 200 is used to read a test pattern and an apparatus for analyzing the read image is also mounted in the inkjet recording apparatus 200 has been described with reference to FIGS. 25 to 30, the present invention can be implemented by a configuration in which a print result of a test pattern is read using an off-line scanner that is independent of the inkjet recording apparatus 200 and data of the read image is analyzed by an apparatus such as a personal computer.

Recording Medium

"Recording medium" is a collective term for media on which dots are recorded by a recording element and include variously named media such as a print medium, a recorded medium, an image-formed medium, an image-receiving medium, and an ejection-receiving medium. When implementing the present invention, materials, shapes, and the like of the recorded medium are not particularly restricted. The present invention can be applied to various types of media regardless of material or shape including continuous-form paper, a cut sheet, a printer label, a resin sheets such as an OHP sheet, film, cloth, a print board on which a wiring pattern or the like can be formed, and a rubber sheet.

Device for Relatively Moving Head and Paper

While a configuration in which a recorded medium is conveyed with respect to a stationary head has been exemplified in the embodiment described above, the present invention can also be implemented with a configuration in which a head is moved with respect to a stationary recorded medium. While a single-pass full-line recording head is normally disposed along a direction perpendicular to a feed direction (conveying direction) of a recorded medium, a mode is also possible in which the head is disposed along an oblique direction having a predetermined angle with respect to a direction perpendicular to the conveying direction.

Modification of Head Configuration

While an inkjet recording apparatus using a page-wide full-line head having a row of nozzles that is long enough to accommodate an entire width of a recording medium has been described in the embodiments described above, a range of application of the present invention is not restricted thereto. The present invention can also be applied to an inkjet recording apparatus which moves a short recording head such as a serial (shuttle scan) head and which records an image by performing a plurality of scanning operations using the head. Moreover, when forming a color image using an inkjet printing head, a head may be disposed for each of a plurality of color inks (recording fluids) or a configuration maybe adopted in which a single recording head is capable of ejecting a plurality of color inks.

Application of the Present Invention

In the embodiments described above, application to the inkjet recording apparatus for graphic printing has been described, but the scope of application of the present invention is not limited to this. For example, the present invention can be applied widely to inkjet systems which form various shapes or patterns using liquid function material, such as wire printing apparatus which forms an image of a wire pattern for an electronic circuit, manufacturing apparatuses for various devices, a resist printing apparatus which uses resin liquid as a functional liquid for ejection, a color filter manufacturing apparatus, a fine structure forming apparatus for forming a fine structure using a material for material deposition, or the like.

Utilization of Non-Inkjet Recording Heads

While an inkjet recording apparatus has been exemplified as an image forming apparatus using a recording head in the description above, a range of application of the present invention is not restricted thereto. In addition to inkjet systems, the present invention can also be applied to various types of image forming apparatuses which perform dot recording such as a thermal transfer recording apparatus having a recording head that uses a thermal element as a recording element, an LED electronic photograph printer having a recording head that uses an LED element as a recording element, and a silver halide photography printer having an LED line exposure head.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A defective recording element detecting apparatus comprising:

an image signal acquiring device which acquires read image signals obtained by reading, at a read pitch WS in a first direction, a linear test pattern recorded by an image recording apparatus having: a recording head in which a plurality of recording elements are aligned so that, when the plurality of recording elements are projected on a straight line that is parallel to the first direction, an interval of projected recording elements is equal to a recording pitch WP; and a medium conveying device which causes relative movement between a recording medium and the recording head in a direction perpendicular to the first direction, the test pattern being recorded by operating recording elements corresponding to projected recording elements per every detection pitch unit PP among the projected recording elements;

a signal decomposing device which sequentially assigns reading pixel numbers 0 to n (where n is a natural number) to the acquired read image signals starting from an end in the first direction, divides the reading pixel numbers by an analysis pitch unit PS to obtain remainders, and decomposes the read image signals into an image signal of each of the obtained remainders;

a fluctuation signal calculating device which calculates a fluctuation signal of each of the remainders based on a predicted signal that is predicted for each of the remainders and on the image signal of each of the remainders; and an identifying device which identifies a defective recording element among the plurality of recording elements based on the fluctuation signal of each of the remainders, wherein a value of the analysis pitch unit PS is set in such a manner that a period T obtained by $$T=WP\times PP/|WS\times PS-WP\times PP|$$

is equal to or exceeds an analysis minimum period set in advance.

2. The defective recording element detecting apparatus as defined in claim 1, wherein the analysis minimum period is three.

3. The defective recording element detecting apparatus as defined in claim 1, wherein the fluctuation signal calculating device generates the predicted signal that is predicted for each of the remainders based on the image signal of each of the remainders, and calculates the fluctuation signal of each of the remainders based on a difference between the generated predicted signal that is predicted for each of the remainders and the image signal of each of the remainders.

4. The defective recording element detecting apparatus as defined in claim 1, wherein the identifying device sets a threshold based on the predicted signal that is predicted for each of the remainders, and identifies the defective recording element based on the threshold.

5. The defective recording element detecting apparatus as defined in claim 1, wherein the identifying device identifies the defective recording element based on a fluctuation signal that is least affected by noise among the fluctuation signals of the respective remainders.

6. An image forming apparatus comprising:

the defective recording element detecting apparatus as defined in claim 1;

a recording head in which a plurality of recording elements are aligned so that, when the plurality of recording elements are projected on a straight line that is parallel to a first direction, an interval of projected recording elements is equal to a recording pitch WP;

a medium conveying device which causes relative movement between a recording medium and the recording head in a direction perpendicular to the first direction;

a first recording control device which operates recording elements corresponding to projected recording elements per every detection unit PP among the projected recording elements so as to record a linear test pattern;

a test pattern reading device which reads and converts the linear test pattern into a read image signal, the read image signal being read at a read pitch WS in the first direction;

a storing device which stores information on the identified defective recording element;

an image correcting device which stops a recording operation of the identified defective recording element and which corrects image data by compensating a recording defect of the defective recording element using the recording elements other than the defective recording element so as to record a target image; and a second recording control device which controls recording operations of the recording elements other than the defective recording element according to image data that has been corrected by the image correcting device, so as to perform image recording.

7. The image forming apparatus as defined in claim 6, wherein the WS is greater than the WP.

8. The image forming apparatus as defined in claim 6, wherein a line width of the test pattern is within a range from 0.5 to 2 times the WS.

9. The image forming apparatus as defined in claim 6, wherein:

the recording elements have ink ejection nozzles, and the defective recording element is based on at least one of a significant position error, a non-ejection, and a significant ejection volume error.

10. The image forming apparatus as defined in claim 6, wherein the test pattern reading device is a line sensor in which a plurality of reading pixels are aligned at the read pitch WS in the first direction.

11. A defective recording element detecting method comprising the steps of:

acquiring read image signals obtained by reading, at a read pitch WS in a first direction, a linear test pattern recorded by an image recording apparatus having: a recording head in which a plurality of recording elements are aligned so that, when the plurality of recording elements are projected on a straight line that is parallel to the first direction, an interval of projected recording elements is equal to a recording pitch WP; and a medium conveying device which causes relative movement between a recording medium and the recording head in a direction perpendicular to the first direction, the test pattern being recorded by operating recording elements corresponding to projected recording elements per every detection unit PP among the projected recording elements;

sequentially assigning reading pixel numbers 0 to n (where n is a natural number) to the acquired read image signals starting from an end in the first direction, dividing the reading pixel numbers by an analysis pitch unit PS to obtain remainders, and decomposing the read image signals into an image signal of each of the obtained remainders;

calculating a fluctuation signal of each of the remainders based on a predicted signal that is predicted for each of the remainders and on the image signal of each of the remainders; and identifying a defective recording element among the plurality of recording elements based on the fluctuation signal of each of the remainders, wherein a value of the analysis pitch unit PS is set in such a manner that a period T obtained by $$T=WP\times PP/|WS\times PS-WP\times PP|$$

is equal to or exceeds an analysis minimum period set in advance.

* * * * *